US007765840B2

(12) United States Patent
Lai et al.

(10) Patent No.: US 7,765,840 B2
(45) Date of Patent: Aug. 3, 2010

(54) DUAL LOCKING PADLOCK

(75) Inventors: Eric Lai, Hong Kong (HK); Karl Lai, Hong Kong (HK)

(73) Assignee: The Sun Lock Company Ltd., Hong Kong (HK)

( * ) Notice: Subject to any disclaimer, the term of this patent is extended or adjusted under 35 U.S.C. 154(b) by 552 days.

(21) Appl. No.: 11/904,128

(22) Filed: Sep. 26, 2007

(65) Prior Publication Data

US 2008/0083251 A1 Apr. 10, 2008

Related U.S. Application Data

(60) Provisional application No. 60/849,716, filed on Oct. 4, 2006.

(51) Int. Cl.
*E05B 37/06* (2006.01)

(52) U.S. Cl. ..... 70/21; 70/25; 70/29; 70/45; 70/284; 70/432

(58) Field of Classification Search ..... 70/21, 70/25–30, 38 A, 41, 45–47, 50, 52–56, 284, 70/285, 432
See application file for complete search history.

(56) References Cited

U.S. PATENT DOCUMENTS

| | | | | | |
|---|---|---|---|---|---|
| 4,803,856 | A * | 2/1989 | Ling | ..... | 70/28 |
| 5,042,277 | A * | 8/1991 | Jenn-Rong | ..... | 70/28 |
| 5,609,048 | A * | 3/1997 | Ling | ..... | 70/28 |
| 5,765,409 | A * | 6/1998 | Yang | ..... | 70/28 |
| 5,782,113 | A * | 7/1998 | Chen | ..... | 70/28 |
| 5,901,587 | A * | 5/1999 | Chen | ..... | 70/28 |
| 6,082,155 | A * | 7/2000 | Su | ..... | 70/22 |
| 6,363,757 | B1 * | 4/2002 | Yu | ..... | 70/28 |
| 6,381,997 | B1 * | 5/2002 | Chen | ..... | 70/28 |
| 6,408,660 | B1 * | 6/2002 | Lai | ..... | 70/30 |
| 6,792,778 | B1 * | 9/2004 | Chen | ..... | 70/21 |
| 6,928,842 | B1 * | 8/2005 | Huang | ..... | 70/21 |
| 6,997,023 | B1 * | 2/2006 | Huang | ..... | 70/21 |
| 7,007,520 | B1 * | 3/2006 | Lin | ..... | 70/21 |
| 7,131,299 | B1 * | 11/2006 | Huang | ..... | 70/21 |
| 7,201,026 | B2 * | 4/2007 | Yu | ..... | 70/21 |
| 7,213,425 | B2 * | 5/2007 | Ling et al. | ..... | 70/21 |
| 7,216,517 | B2 * | 5/2007 | Ling et al. | ..... | 70/21 |
| 7,222,506 | B2 * | 5/2007 | Yu | ..... | 70/21 |
| 2005/0235706 | A1 * | 10/2005 | Ling et al. | ..... | 70/29 |
| 2005/0235707 | A1 * | 10/2005 | Ling | ..... | 70/29 |
| 2006/0130540 | A1 * | 6/2006 | Lin | ..... | 70/21 |
| 2008/0011026 | A1 * | 1/2008 | Huang | ..... | 70/21 |

* cited by examiner

*Primary Examiner*—Suzanne D Barrett
(74) *Attorney, Agent, or Firm*—Melvin I. Stoltz

(57) ABSTRACT

By providing a single housing and shackle assembly constructed for enabling the shackle to be opened and/or closed using either a rotatable dial combination construction or a key activating tumbler construction, with the movement of the shackle being controlled by a trigger member, an effective, easily produced, padlock is achieved which incorporates two separate and independent locking systems formed in a single padlock. In addition, the trigger member and shackle each incorporate uniquely constructed, cooperating surfaces, each of which comprise a grooved zone or concave curved zone which is positioned directly adjacent a cooperating convexly curved zone. By employing these two curved surfaces on both the shackle and trigger member, the controlled pivotal movement of the shackle is realized.

23 Claims, 19 Drawing Sheets

DUAL LOCKING PADLOCK

RELATED APPLICATIONS

This application is related to U.S. Provisional Patent Application Ser. No. 60/849,716, filed Oct. 4, 2006 entitled DUAL LOCKING PADLOCK.

TECHNICAL FIELD

This invention relates to padlocks and lock systems and, more particularly, to padlocks constructed to provide two separate an independent modes by which the padlock can be opened and closed, while also providing an automatically activated indicator or signal whenever the padlock has been opened using one specific mode.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades and have been constructed in a wide variety of forms and shapes, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that has been implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

In addition, although some prior art locks do provide a dual locking system for enabling security personnel to gain access to the lock, when necessary, a further problem has been created. In this regard, consumers wish to know when security personnel have opened their luggage in order to gain access to the interior thereof. Since the dual locking systems enable security personnel to open the luggage, inspect the contents, and reclose and lock the suitcase, consumers have no knowledge as to what action, if any, has been taken by security personnel. As a result, in addition to having locks which incorporate dual locking modes, consumers also seek to have these locks incorporate an automatically initiated indicator or signal which will inform the consumer whenever the lock has been opened using the key portion of the lock.

Although some preliminary attempts to satisfy this need have been made by prior art systems, the prior art systems have been incapable of providing an easily initiated, reliable, positive indicator or signal. In particular, these prior art products fail to provide an easily seen positive indicator/signal which provide consumers with the positive notice desired. Furthermore, these prior art products are extremely complicated, requiring numerous components for achieving the end result.

In addition, many such prior art products require the consumer to input the predetermined combination into the lock in order to release the shackle for resetting the signaling device. This often requires the consumer to open their locks in areas where an observer would be able to see the combination, and use that combination to the detriment of the consumer.

Therefore, it is the principal object of the present invention to provide a padlock having a fully integrated dual locking system which also incorporates a positive indicator or signal for informing the consumer whenever the key portion of the padlock has been employed.

Another object of the present invention is to provide a padlock having the characteristic features described above which is easily produced and provides the user with complete control over the resetting of the indicator.

Another object of the present invention is to provide a padlock having the characteristic features described above which provides an indicator or signal which is highly visible and easily seen by the user.

A further object of the present invention is to provide a padlock having the characteristic features described above which enables the user to reset the indicator or signal while the lock is completely closed and locked.

Other and more specific objects will in part be obvious and will in part appear hereinafter.

SUMMARY OF THE INVENTION

By employing the present invention, all of the difficulties and drawbacks of prior art constructions are essentially eliminated and an effective, easily produced, padlock is achieved which incorporates two separate and independent locking systems formed in a single padlock. In addition, a unique shackle construction is provided which is responsive to both locking systems for independently enabling the single shackle to be released and/or lockingly engaged in response to the activation of either locking system. In this way, by using the key activating portion, a user is assured of the ability to release a shackle from locked engagement, while also assuring that the user is able to release a shackle from locked engagement with the housing by employing the combination controlled portion.

In accordance with the present invention, a single housing and shackle assembly are employed and constructed for enabling the shackle to be opened and/or closed using either a rotatable dial combination construction or a key activating tumbler construction. In this way, a dual locking and releasing padlock is achieved which virtually eliminates the difficulties typically encountered with known prior art lock configurations.

In the preferred embodiments of the present invention, a uniquely constructed shackle is employed which preferably comprises an arcuately curved, elongated finger member which is formed in two mating sections. One section of the shackle forming finger member is fixedly mounted to the housing, while the other section is movably or pivotally mounted to the housing. In this way, the shackle is able to be opened and/or closed in response to the appropriate locking and unlocking of the padlock, with the shackle member being moved between a first, aligned, inter-engaged and locked position and a second, separated and unlocked position.

In order to control the movement of the shackle member for enabling the shackle to be opened and/or closed, the pivotal or movable portion of the shackle is movable in response to the activation of either the combination controlled section or the key controlled section of the padlock. Regardless of which section is unlocked, the movable shackle portion is able to be pivoted from its closed position to its open position.

In the preferred construction, the movable, finger-like shackle section is preferably mounted at its proximal end in an enlarged base which is mounted to the housing for pivotal movement in its entirety. In addition, one side surface of the base incorporates a grooved zone or concave curved zone which is positioned directly adjacent a cooperating convexly curved zone. By employing these two curved surfaces in combination with a mating trigger member, the controlled pivotal movement of the base and shackle portion are realized.

In the preferred embodiment, the trigger member employed in the padlock of the present invention is pivotally mounted to the housing and is preferably constructed with its pivot axis substantially parallel to the pivot axis of the shackle base. In addition, the trigger member incorporates an edge or side surface which comprises a concavely curved zone formed directly adjacent a convexly curved zone. Furthermore, when the trigger member is mounted in the housing, this dual convex edge or side surface is positioned directly adjacent to the dual curved surfaces of the base member and is constructed for co-operating, controlled engagement therewith.

As is fully detailed below, the trigger member is constructed to move between two alternate positions for controlling the locking and unlocking of the shackle. In a first position, the trigger member is positioned to prevent the base member from moving, thereby securely locking the shackle holding base in its closed position, maintaining the shackle closed and locked. In its second position, a trigger member is positioned to allow the base member to arcuately pivot, thereby allowing the shackle forming finger portion mounted therein to pivot into its open and unlocked position.

In the preferred construction of the preferred embodiment of the present invention, the arcuately curved, concave zone or groove zone of the trigger member and the arcuately curved convex zone of the base member comprise substantially identical or cooperating radii of curvatures, while the arcuately curved convex zone of the trigger member and arcuately curved concave zone or groove zone of the base member comprise substantially identical or cooperating radii of curvatures.

As a result of this construction, whenever the concave zone of the trigger member is aligned with the convex zone of the base member, the base member is capable of pivoting movement relative to the trigger member. However, the trigger member is locked and is incapable of movement.

Similarly, whenever the arcuately curved convex zone of the trigger member is aligned with the arcuately curved concave zone of the base member, the trigger member is capable of arcuate pivoting movement relative to the base member. However, the base member is locked and incapable of movement. By employing this construction, the desired locked and unlocked cooperative relationship of these components is realized.

In the preferred embodiment of the present invention, the ability of the trigger member to move between its shackle locking and shackle releasing positions is controlled by either the combination controlling portion or the key controlled portion of the padlock. In this regard, whenever the correct pre-set combination has been entered into the rotatable dials mounted in the housing of the padlock, a pushbutton is able to be moved for causing the trigger member to arcuately pivot between its shackle blocking position and its shackle released position.

In addition, whenever the key controlled portion of the padlock is activated by employing the matching key member, the arcuate pivoting movement of the tumbler holding cylinder associated with the key controlled portion impacts directly upon the trigger member, moving the trigger member from its shackle blocking position to its shackle releasing position. In this way, the desired opening of the padlock is achieved using either the key controlled portion or the combination controlled portion of the padlock of the present invention, with the desired release of the shackle member being achieved.

In the preferred construction of the present invention, an activation alert system is incorporated in the key controlled portion of the padlock for informing the consumer that the key controlled portion of the padlock has been employed. In this regard, in this embodiment, a movable ring member is associated with the cylinder assembly for being arcuately pivoted simultaneously with the movement of the tumbler holding cylinder whenever the key controlled portion is activated.

In addition, once so activated, the ring is locked in its alert position, for enabling the owner of the padlock to immediately know that the key controlled portion of the padlock has been employed. In this way, whenever security personnel uses the key controlled portion to open the padlock on a suitcase, or other similar product, the owner of the suitcase is immediately informed by observing the padlock that the key controlled portion has been employed.

In an alternate embodiment of the present invention, a further padlock construction is achieved which employs similarly constructed arcuately curved, concave zones or groove zones in combination with arcuately curved convex zones which are formed on a trigger member and shackle and are cooperatively associated with each other to control the opening and locking engagement of the shackle in the padlock. In this alternate embodiment of the present invention, the shackle preferably comprises a generally U-shape, having one free end which is securely mountable in engagement with a receiving aperture formed in the housing of the padlock for maintaining the padlock in its closed position. In addition, the shackle is constructed for pivoting movement relative to the housing of the padlock, for enabling the opening of the padlock when activated by either the combination controlled portion or the key controlled portion formed therein.

In the preferred construction of this alternate embodiment of the present invention, the pivoting end of the shackle incorporates the combined arcuately curved convex zone and the arcuately curved concave zone or groove zone for controlling the locking and releasing of the shackle. In addition, a trigger member is pivotally mounted in the housing of the padlock in cooperating association with the dual curved zone of the shackle for lockingly engaging and releasing the shackle in response to the pivoting movement thereof.

In this regard, the trigger member also comprises a dual curved zone comprising an arcuately curved convex zone in an arcuately curved concave zone or groove zone which is constructed and positioned for cooperating inter-engagement with the curved zones of the shackle. In this way, the desired locked engagement of the shackle with the housing of the padlock is achieved, when desired, as well as the release of the shackle, in a manner substantially identical to the construction detailed above.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the present invention, reference should be had to the following detailed description taken in connection with the accompanying drawings, in which.

Figure 15:
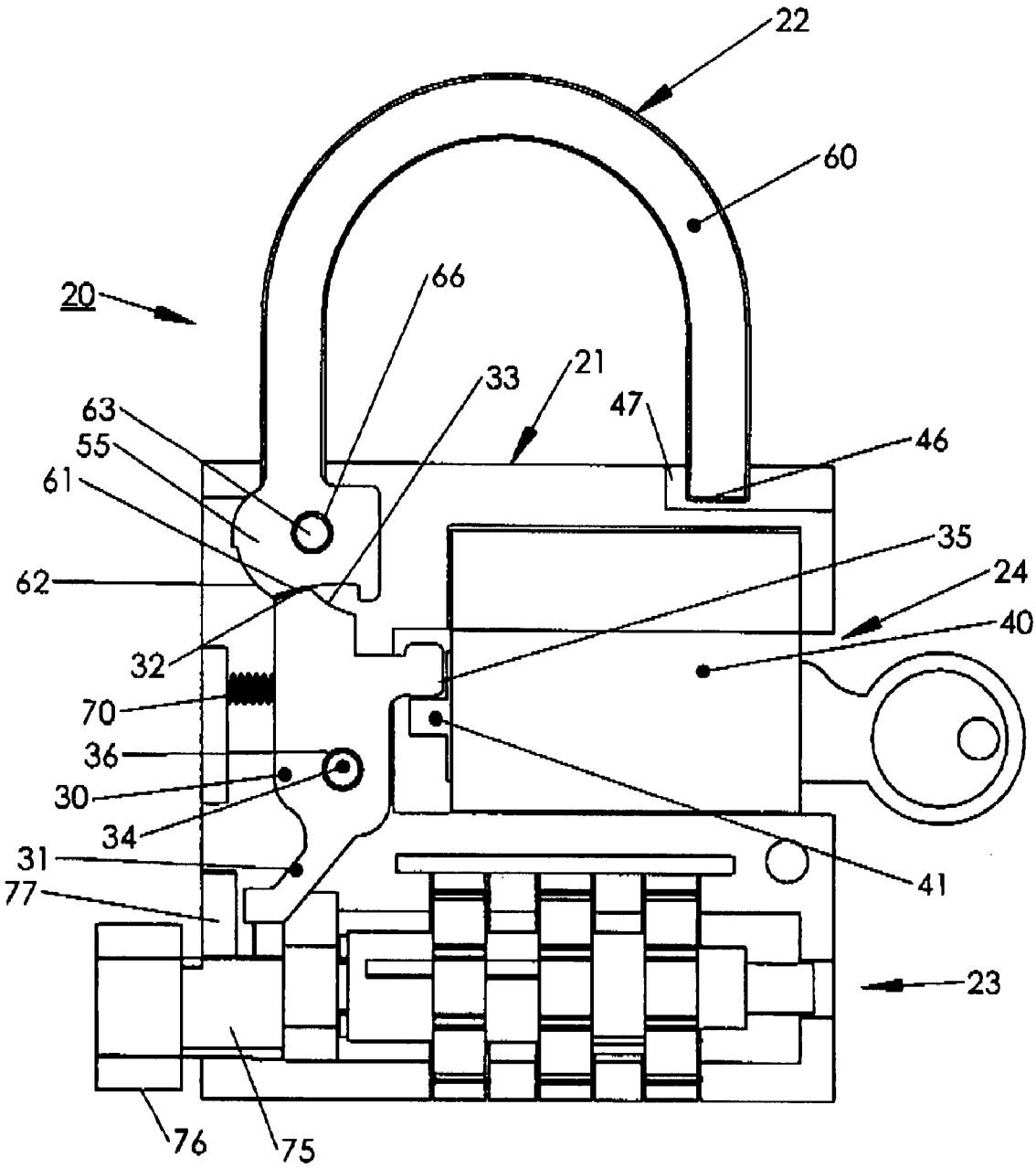
FIG. 15 is a side elevation view depicting a second embodiment of the dual locking padlock of the present invention shown with the cover plate removed and in the locked position.
Figure 16:
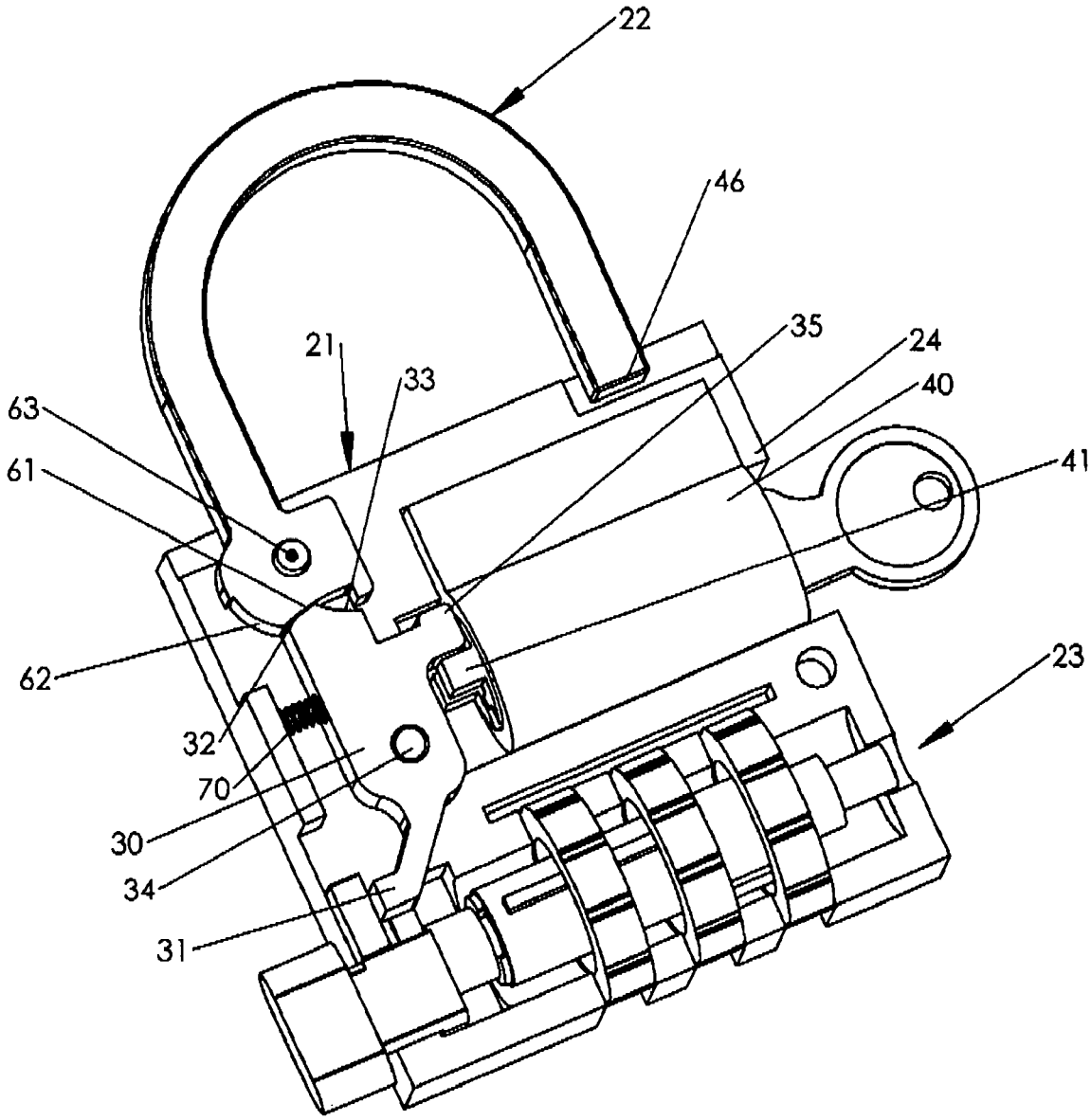
FIG. 16 is a perspective view of the dual locking padlock of FIG. 15.
Figure 17:
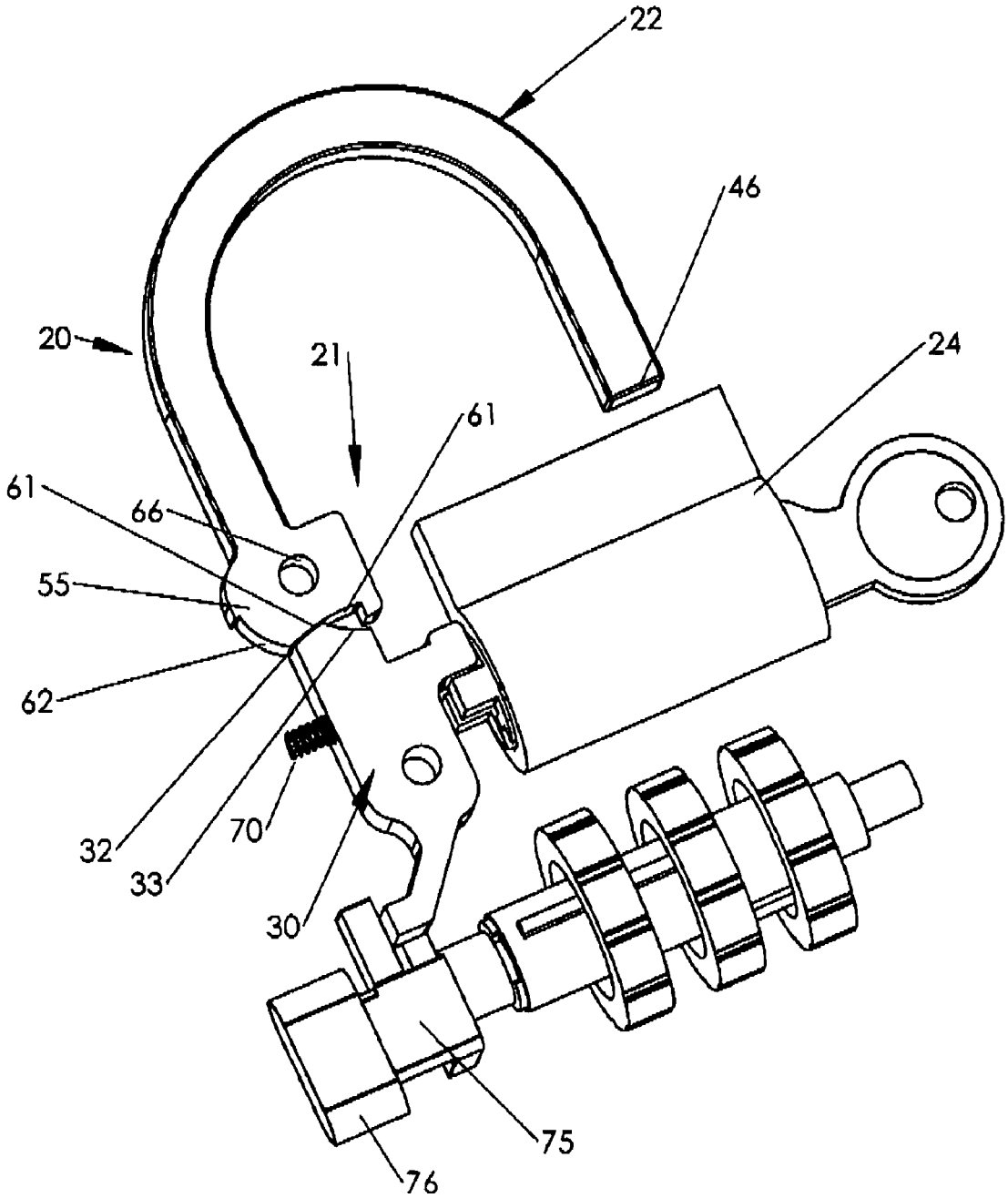
FIG. 17 is a perspective view of the dual locking padlock of FIG. 16 shown with the housing removed.
Figure 18:
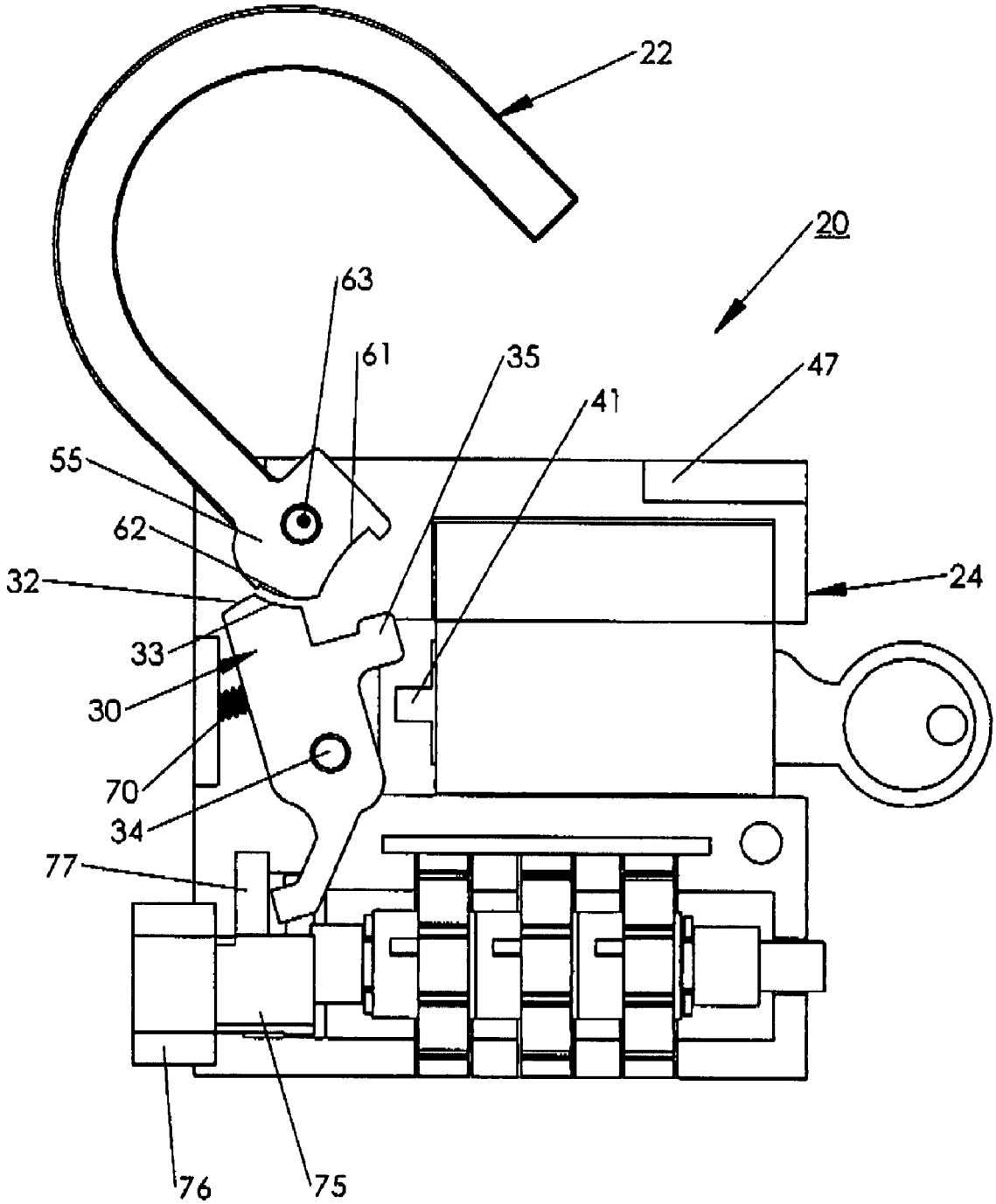
FIG. 18 is a side elevation view of the dual locking padlock of FIG. 15 shown with the cover plate removed and in the open position by employing the combination controlled section.
Figure 19:
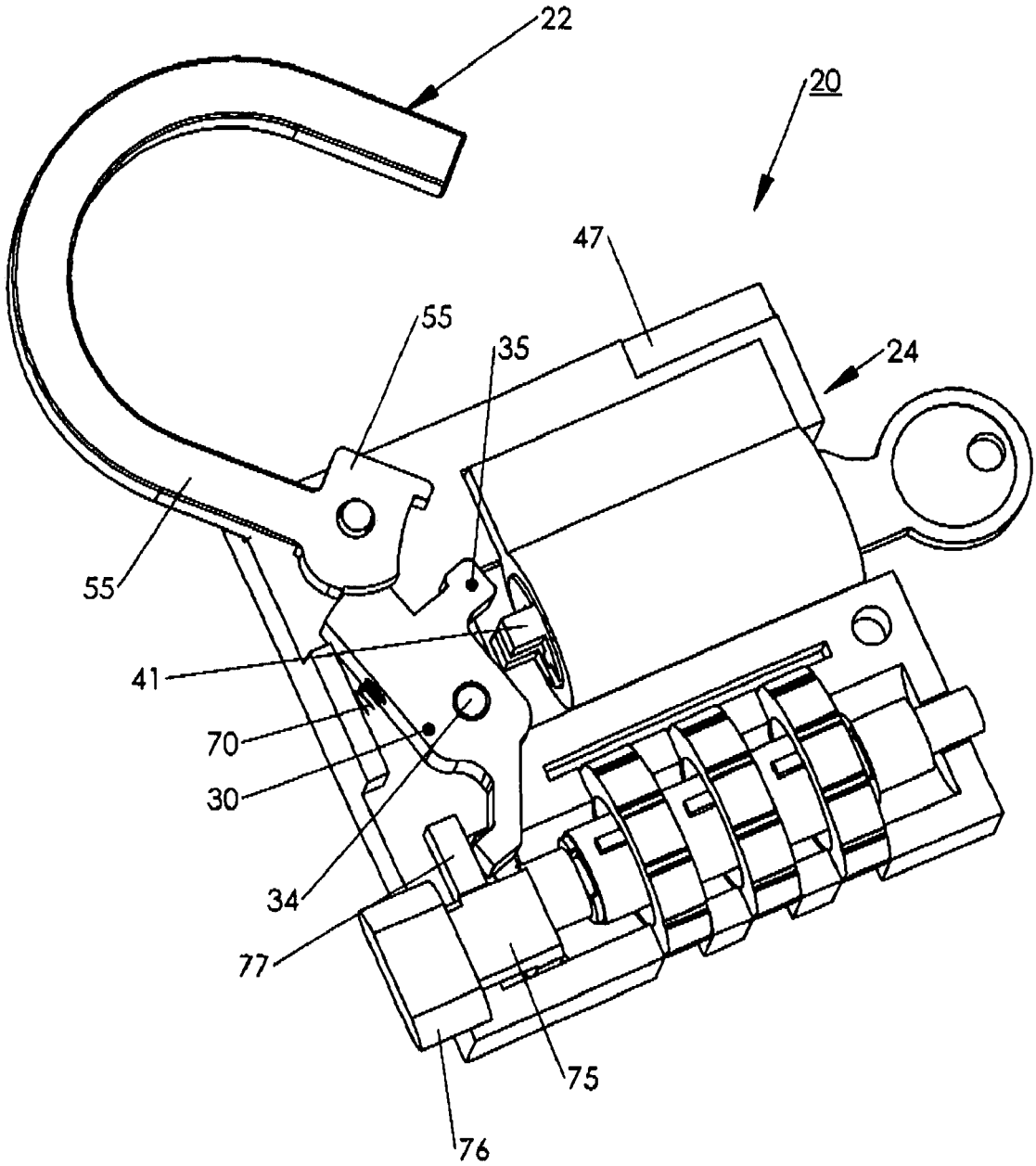
FIG. 19 is a perspective view of the dual locking padlock of FIG. 18.
Figure 20:
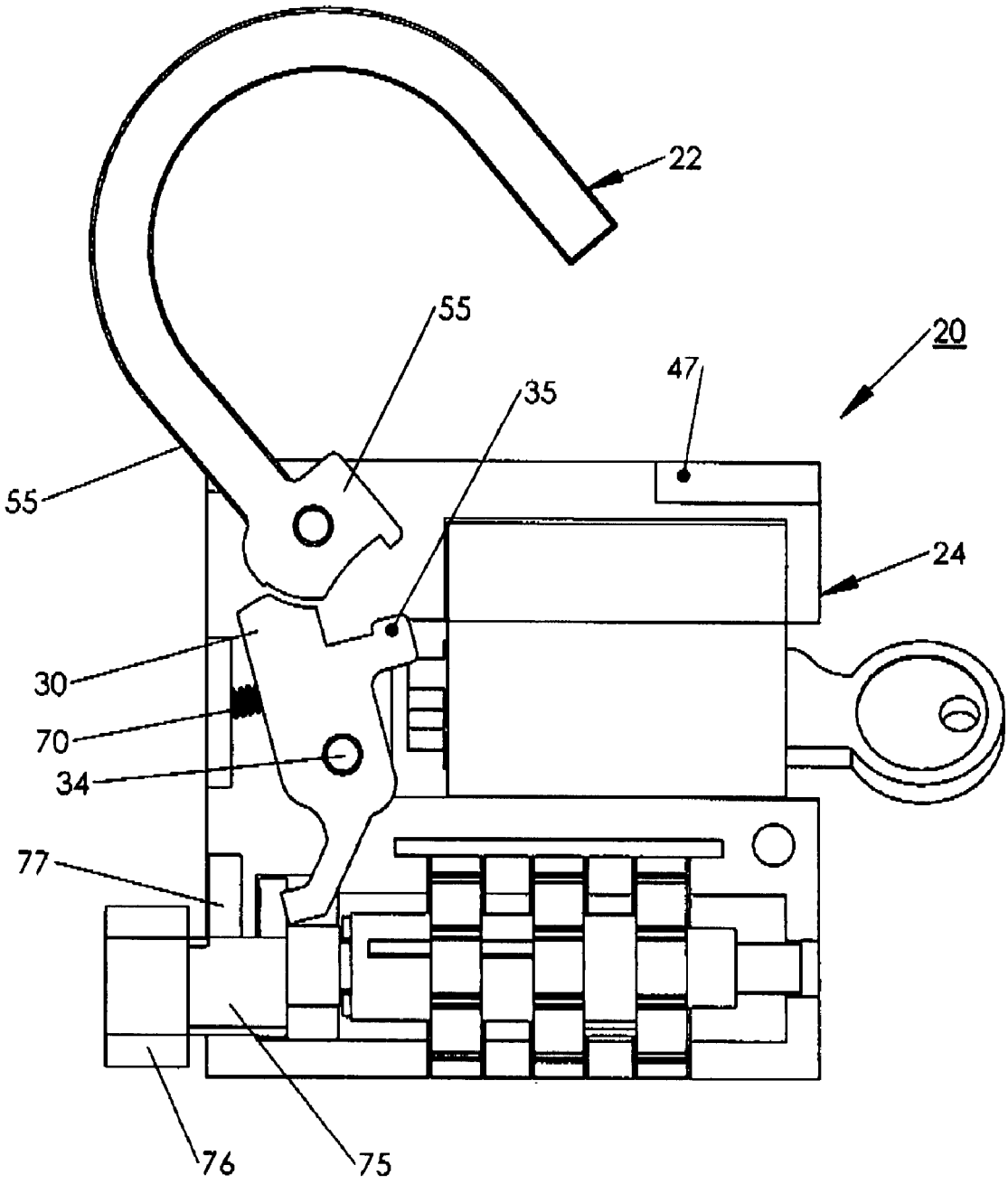
FIG. 20 is a side elevation view of the dual locking padlock of FIG. 15 shown with the cover plate removed and in the open position by employing the key controlled section.
Figure 21:
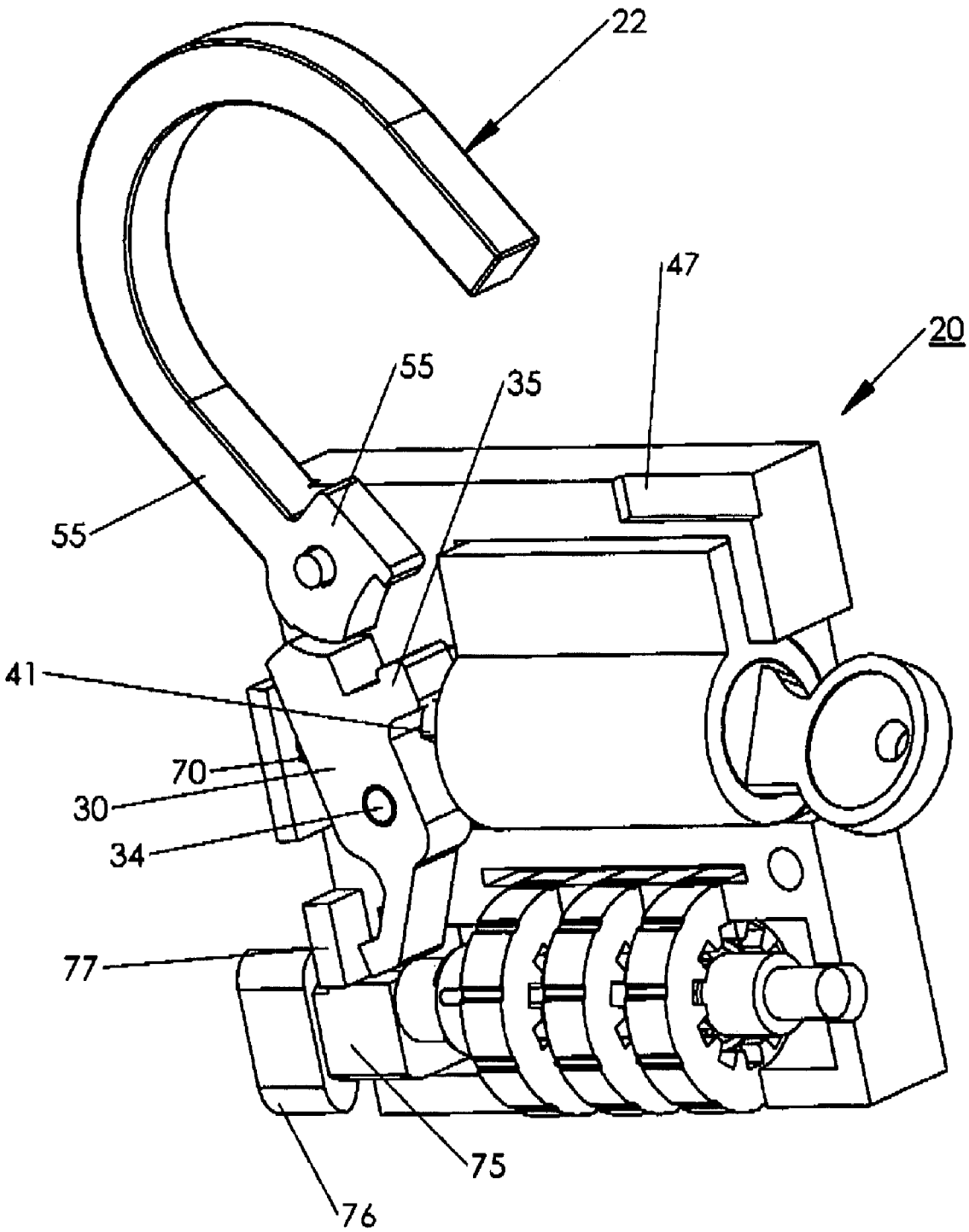
FIG. 21 is a perspective view of the dual locking padlock of FIG. 20.
Figure 22A:
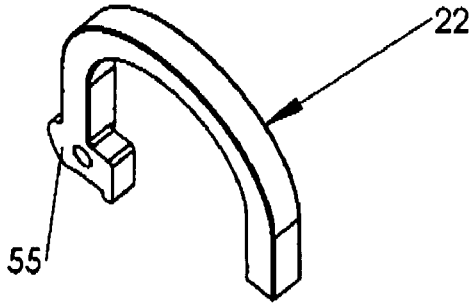
Figure 22B:
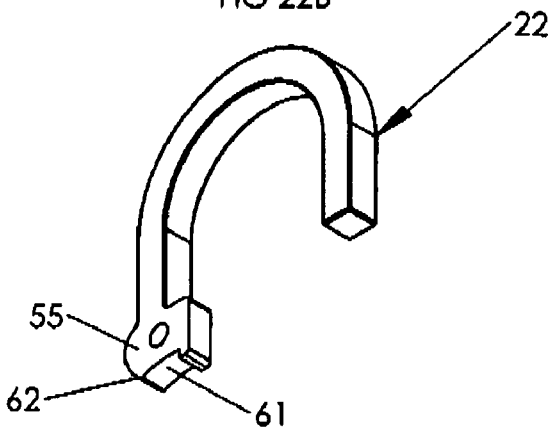
Figure 22D:
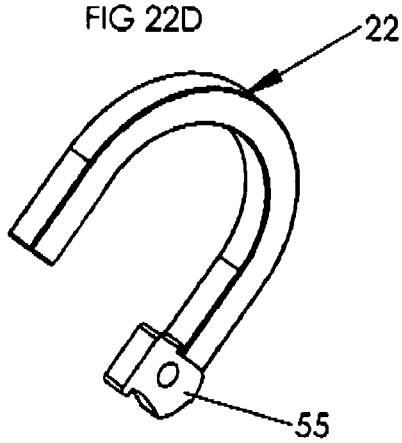
Figure 22C:
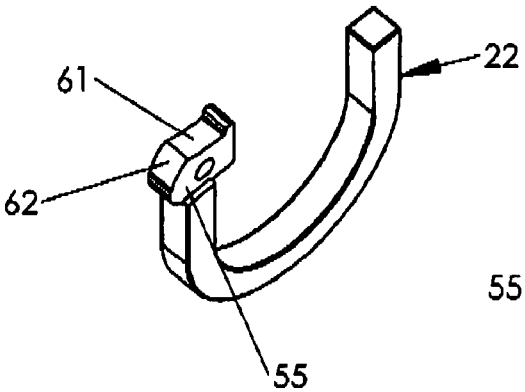
Figure 22E:
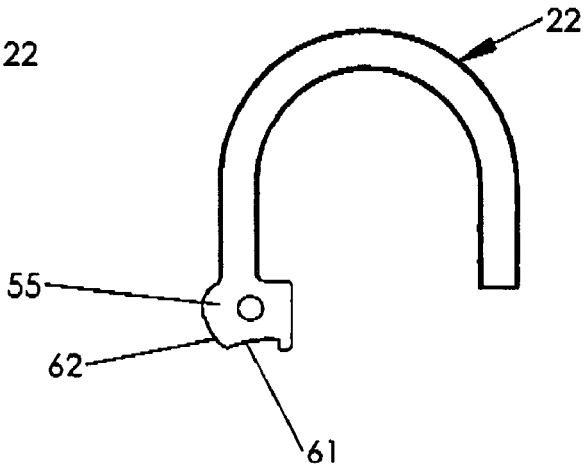
Figure 23A:
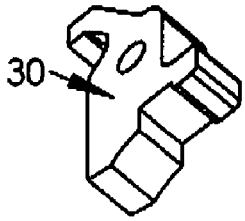
Figure 23B:
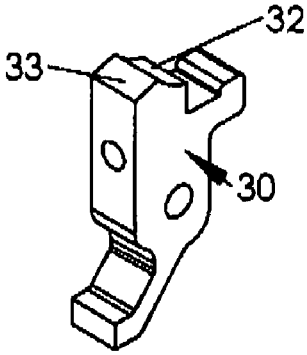
Figure 23D:
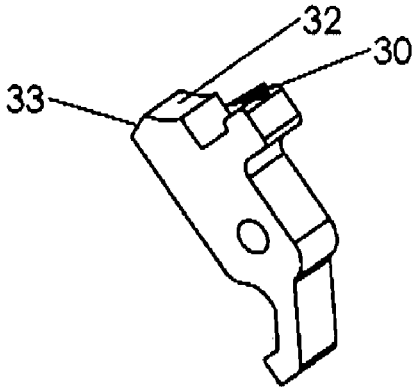
Figure 23C:
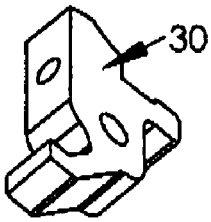
Figure 23E:
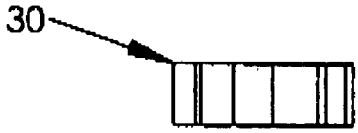
Figure 23F:
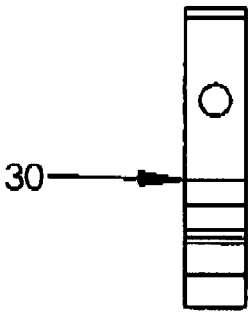
Figure 23G:
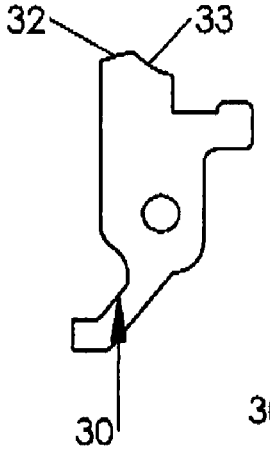
Figure 23H:
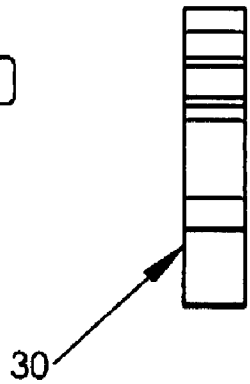

FIG. 22, which consists of five elements designated as FIGS. 22A, 22B, 22C, 22D and 22E, is a series of alternate views depicting the shackle employed in the dual locking padlock of FIG. 15; and FIG. 23, which consists of eight elements designated as FIGS. 23A, 23B, 23C, 23D, 23E, 23F, 23G, and 23H, is a series of alternate views depicting the trigger member employed in the dual locking padlock of FIG. 15.

DETAILED DISCLOSURE

By referring to FIGS. 1-23, along with the following detailed discussion, the construction and operation of two alternate preferred embodiments of dual mode padlock 20 of the present invention can best be understood. However, numerous variations may be made in the present invention without departing from the scope of this invention. Consequently, it is to be understood that the following detailed disclosure of the embodiments shown in FIGS. 1-23, are provided for exemplary purposes only and are not intended as a limitation of the present invention.

In FIGS. 1-14, one preferred embodiment of dual mode padlock 20 of the present invention is depicted using a minimum number of principal component, thereby achieving a dual mode padlock while also substantially reducing the complexity found in most prior art padlocks. In this way, the invention provides a highly effective, commercially desirable construction which is capable of being produced at competitive costs, while also providing the unique attributes of the present invention and all of the locking and theft deterrent features typically incorporated in prior art padlocks.

Furthermore, as fully detailed herein, both embodiments of the present invention incorporate uniquely constructed dual curved zones formed in association with the shackle of the padlock, in combination with cooperating dual curved zones formed on a pivotable trigger member which is mounted in controlling engagement with the shackle. By employing this construction, a highly effective, easily produced, dual mode padlock is realized which is capable of providing all of the attributes desired in a highly effective, competitively priced padlock.

In both embodiments of the present invention, two of the principal components which form dual mode padlock 20 comprise housing 21 and shackle 22. In addition, housing 21 incorporates combination controlled locking section 23 formed on one side thereof in key controlled locking section 24 formed on the oppose side thereof. The components required for forming an operating combination controlled locking section 23 as well as a component required for forming an operating key controlled locking section 24 are all detailed below. However, regardless of the section used by an individual to lock and unlock padlock 20 of the present invention, movement of shackle 22 between a locked and unlocked position is employed.

In the first preferred embodiment of the present invention, shackle 22 comprises an arcuately curved finger member which incorporates two mating sections 26 and 27. As depicted, section 26 is fixedly mounted to upstanding post 28 of housing 21, while section 27 is affixed to mounting block 140. Furthermore, mounting block 140 is pivotally mounted to housing 21 by securing mounting block 142 to upstanding support post 139 of housing 21 which defines pivot axis "C2".

In the preferred construction of this embodiment of the present invention, mounting block 140 incorporates section 26 of shackle 22 fixedly mounted to one side surface thereof while also incorporating dual curved zones 141 and 142 formed in an opposed side surface thereof. Furthermore, as is more fully detailed below, arcuately curved zone 141 preferably comprises an inwardly extending, concavely curved zone or groove zone, while curved zone 142 comprises an outwardly extending, convexly curved zone. As shown, curved zones 141 and 142 are preferably formed directly adjacent each other extending along a common side surface of mounting block 140.

By employing this construction and forming passageway or hole 148 in mounting block 140, mounting block 140 is mounted to support post 139 of housing 21 for providing arcuate pivoting movement relative thereto. In addition, as is fully detailed below, the arcuate pivoting movement of mounting block 140 is controlled by pivotable trigger member 150. Furthermore, since shackle forming section 27 is affixed to mounting block 140, the arcuate pivoting movement of mounting block 140 causes shackle forming section 27 to move into and out of alignment with shackle forming section 26. In this way, the opening and closing of dual mode padlock 20 is achieved, alternately enabling a user to gain access to padlock 20 through shackle 22 as well as preventing access to shackle 22 and any item to which padlock 20 has been secured.

In accordance with the present invention, the controlled movement of mounting block 140, and the resulting locking and unlocking of padlock 20 is achieved by employing trigger member 150. As shown, trigger member 150 incorporates hole or passageway 158 formed therein which enables trigger member 150 to be pivotally mounted to housing 21 by securing trigger member 150 to upstanding support post 149 which is affixed to housing 21 of padlock 20. In this way, pivot axis "C1" is established, with pivot axis "C1" being aligned in parallel relationship with pivot axis "C2".

In addition, trigger member 150 incorporates two arcuately curved zones 151 and 152, formed adjacent each other on one side surface of trigger member 150. In the preferred construction, arcuately curved zone 151 comprises an inwardly extending, concavely curved zone or groove zone, while curved zone 152 comprises an outwardly extending, convexly curved zone.

Furthermore, as clearly depicted in the Figures, dual curved zones 151 and 152 of trigger member 150 are mounted in aligned, cooperating, controlling relationship with dual curved zones 141 and 142 of mounting block 140. As is fully detailed below, by employing this construction, the desired arcuate pivoting movement of mounting block 140 and the resulting opening and closing of shackle 22 is achieved.

In the preferred embodiment, the radius of curvature employed for defining curved zone 152 is substantially equivalent to the radius of curvature employed for forming curved zone 141. In this regard, both curved zones 152 and 141 employ pivot axis Cl as the center point of both arcuate curves. Furthermore, as clearly shown in FIG. 1, whenever arcuately curved zone 152 is mounted within arcuately curved zone 141, pivoting movement of mounting block 140 is prevented, thereby causing section 27 of shackle 22 to be maintained in its aligned, shackle closed position, resulting in padlock 20 being maintained in the secured and locked position.

In addition the radius of curvature employed for defining curved zone 151 is substantially equivalent to the radius of curvature employed for forming curved zone 142. In this regard, both curved zones 151 and 142 employ pivot axis C2 as the center point of both arcuate curves.

Figure 5:
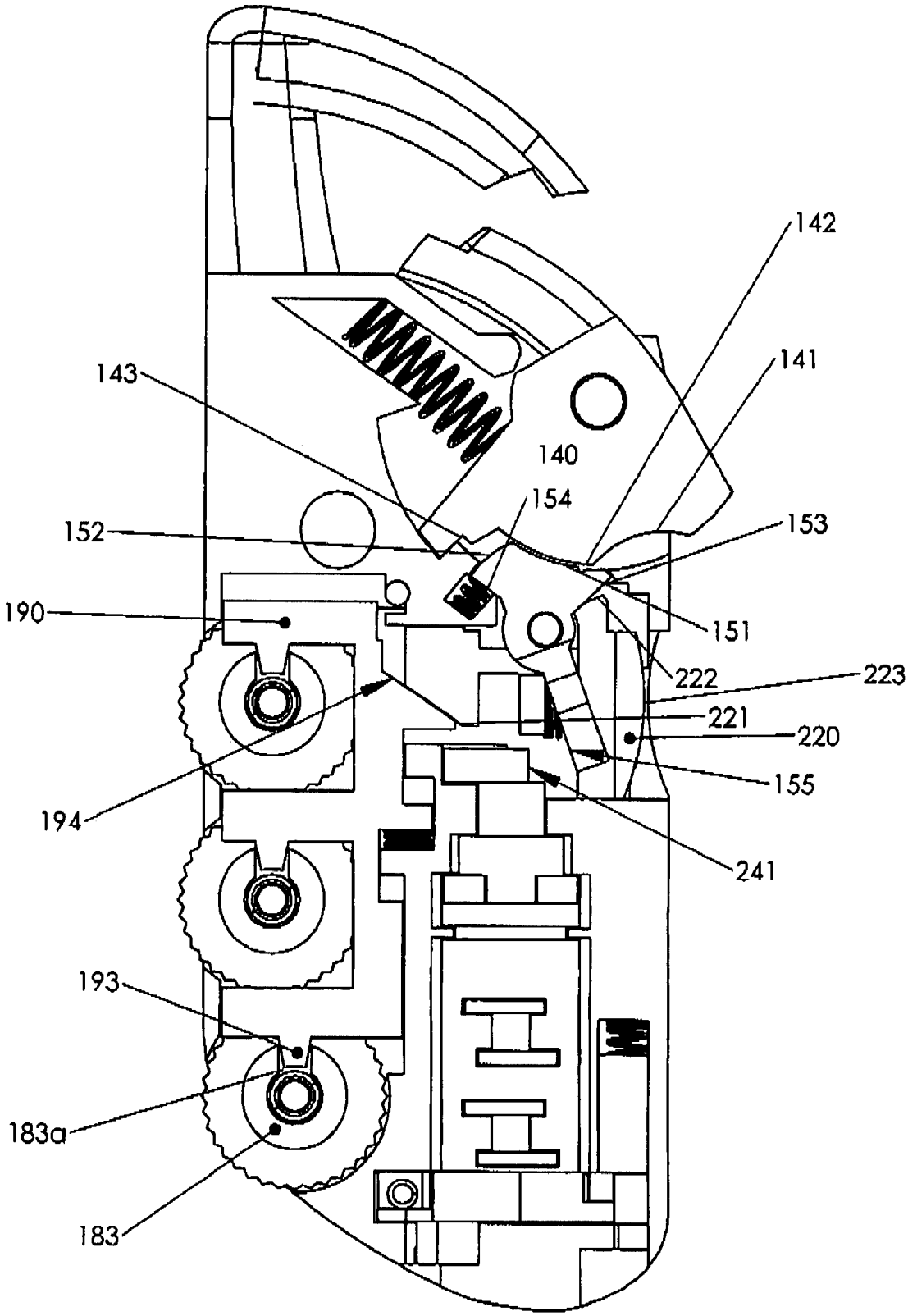
FIG. 5 is a side elevation view of the dual locking padlock of FIG. 1 shown with the cover plate removed and in the open position by employing the combination controlled section.
Figure 6:
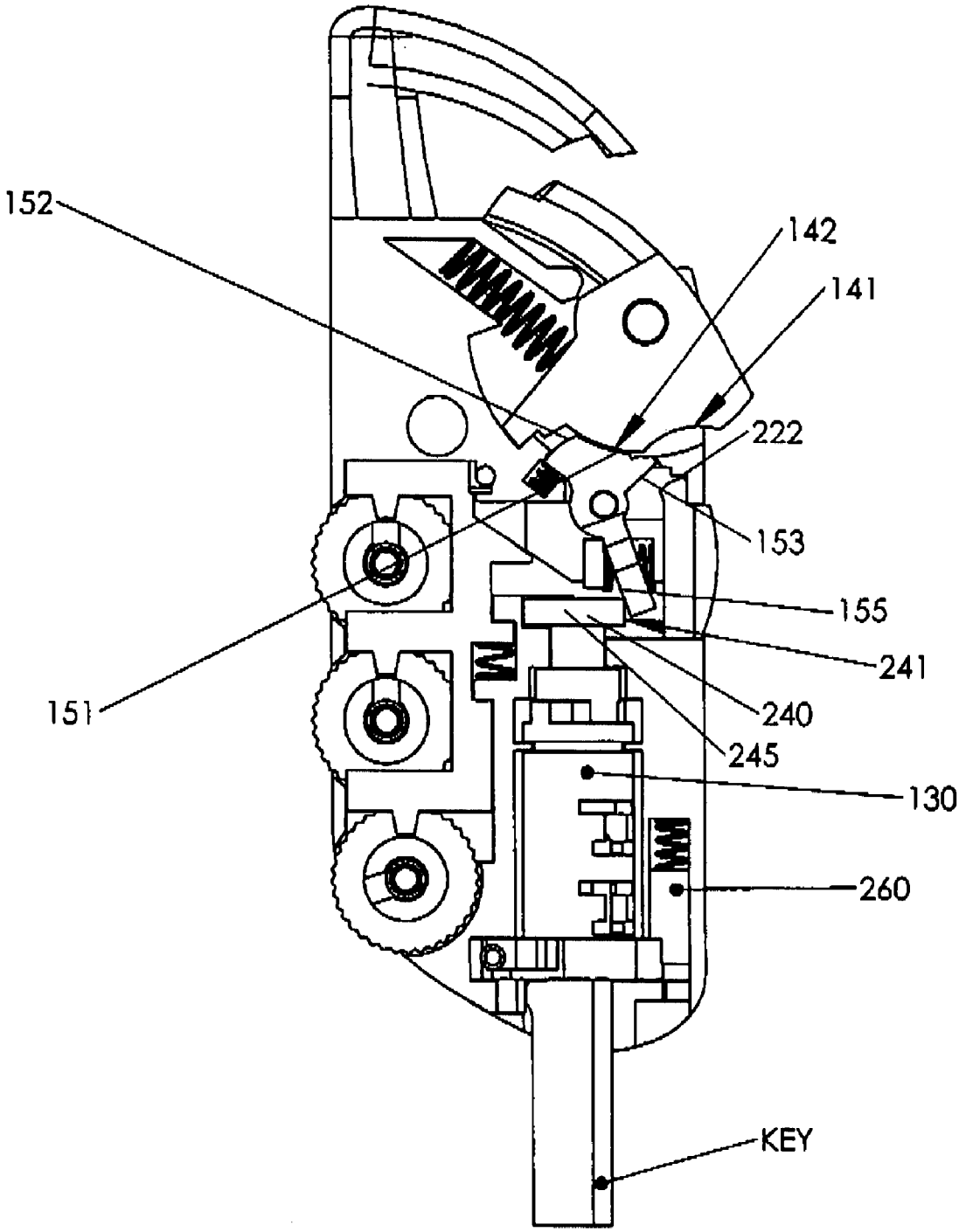
FIG. 6 is a side elevation view all the dual locking padlock of FIG. 1 shown with the cover plate removed in the open position by employing the key controlled section.
Figure 7:
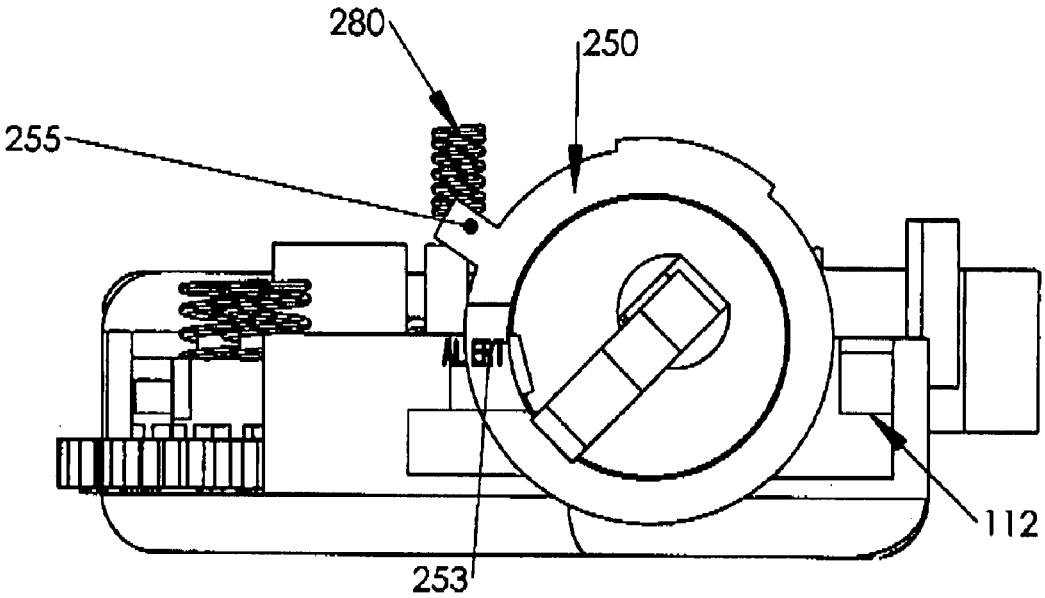
FIG. 7 is an end view of the dual locking padlock of FIG. 6.
Figure 8:
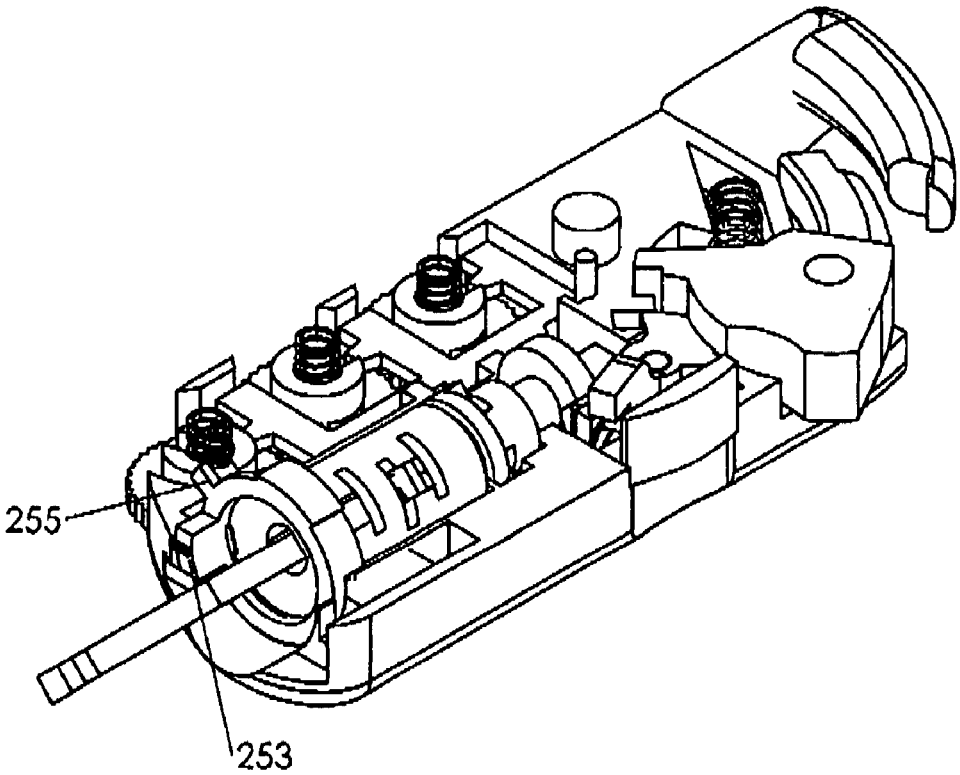
FIG. 8 is a perspective view of the dual locking padlock of FIG. 6.
Figure 9:
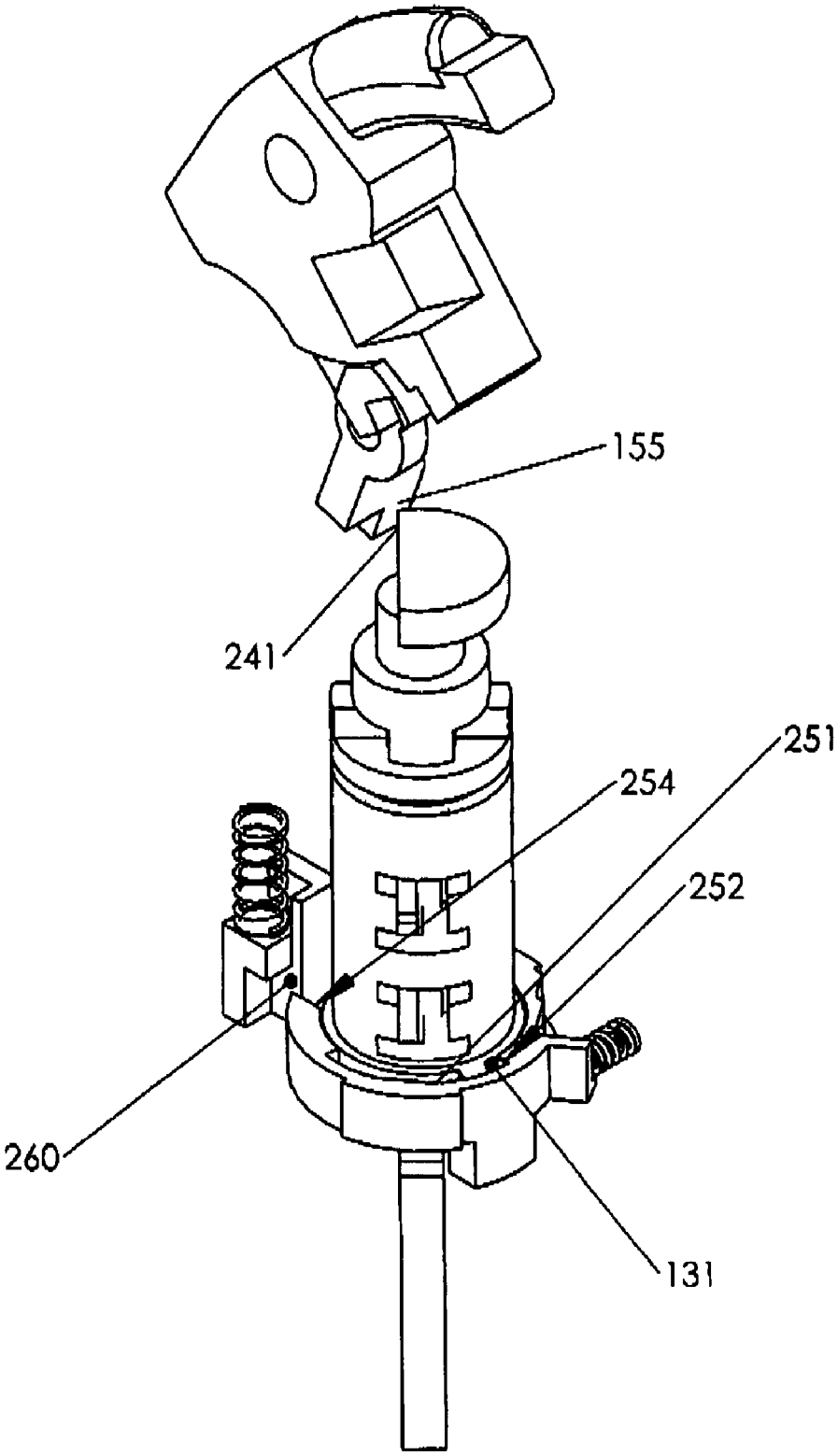
FIG. 9 is a perspective view of the dual locking padlock of FIG. 6 depicted with the housing removed.
Figure 10:
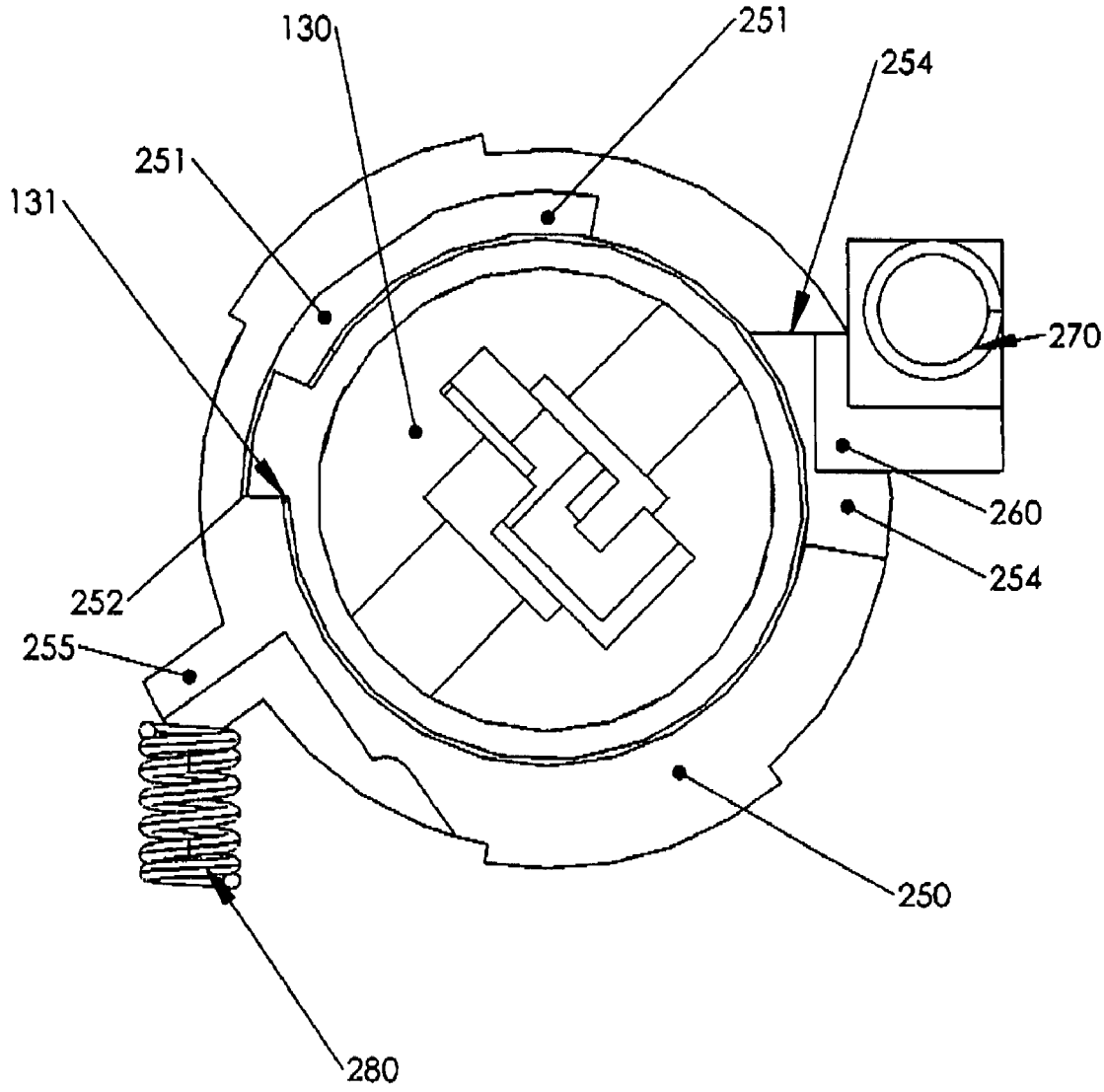
FIG. 10 is an end view of the key controlled locking section of the padlock of FIG. 6.
Figure 11:
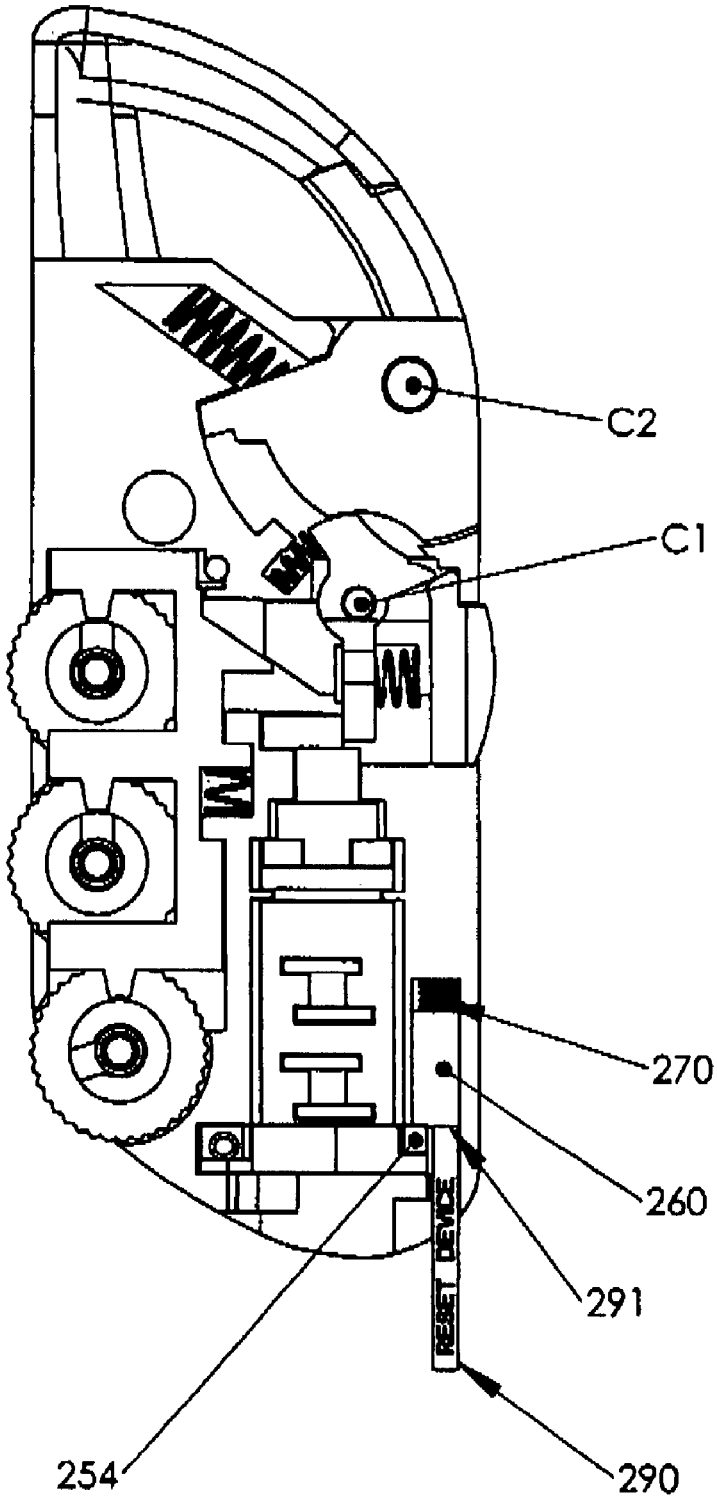
FIG. 11 is a side elevation view of the dual locking padlock of FIG. 6 shown with the alert indicator being reset.
Figure 12:
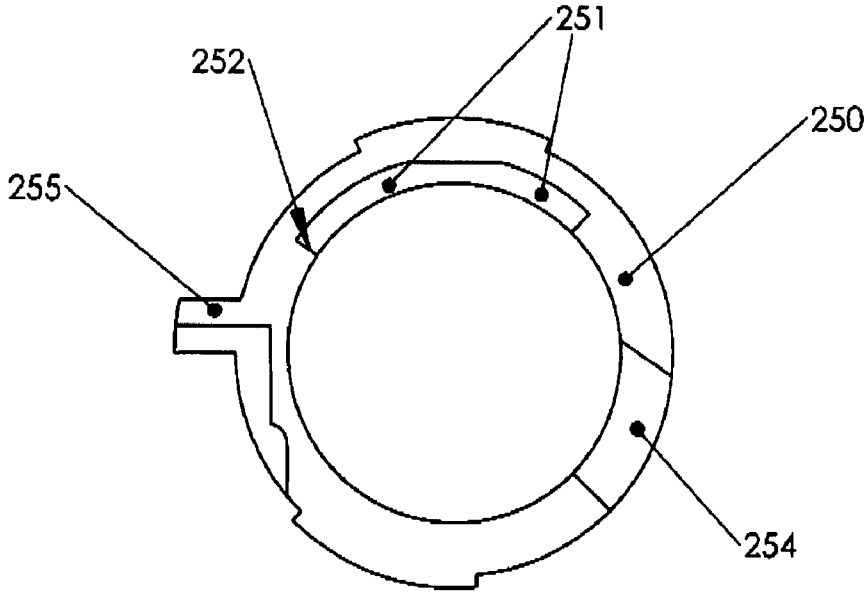
FIGS. 12-14 are detail views of depicting the alert indicator construction employed in the dual locking padlock of the present invention.
Figure 13:
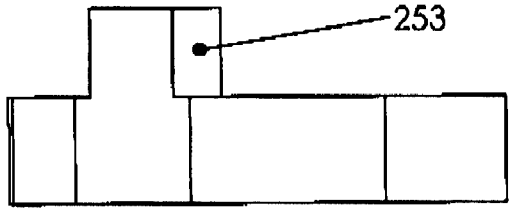
Figure 14:
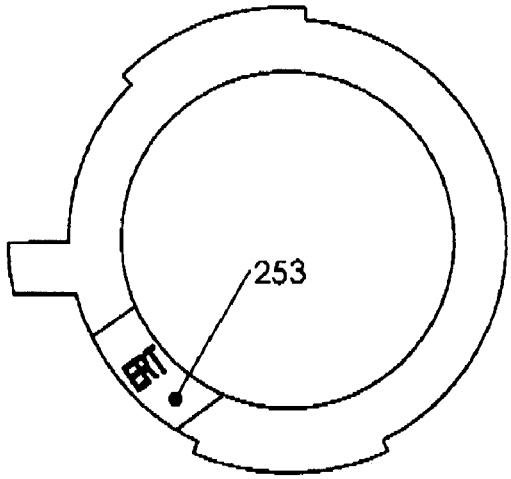

As clearly shown in FIG. 5, when trigger member 150 is arcuately pivoted into its second, alternate position, curved zone 151 of trigger member 150 is moved into cooperating alignment with curved zone 142 of mounting block 140. Once trigger member 150 is moved into this second position, mounting block 140 is capable of arcuate pivoting movement relative to housing 21, with curved surface 142 slidingly moving in juxtaposed, spaced, aligned relationship with curved zone 151. In addition, as detailed above, once mounting block 140 arcuately pivots into its second position, shackle forming section 22 is moved out of alignment with shackle forming section 26, thereby opening shackle 22 and resulting in padlock 20 being removable from the items to which it had been mounted.

Due to the construction of curved zone 152 of trigger member 150 and curved zone 141 of mounting block 140, wherein both curved zones comprise cooperating or identical radii of curvatures, along with curved zone 151 of trigger member 150 and curved zone 142 of mounting block 140 also comprising cooperating or identical radii of curvatures, the controlled arcuate pivoting movement of trigger member 150 and mounting block 140 is attained with padlock 20 being controllably moved between a securely locked position and an unlocked position. In addition, based upon the position of trigger member 150 relative to mounting block 140, mounting block 140 is either maintained in a secure, locked position or is able to be arcuately pivoted into its unlocked position.

Figure 1:
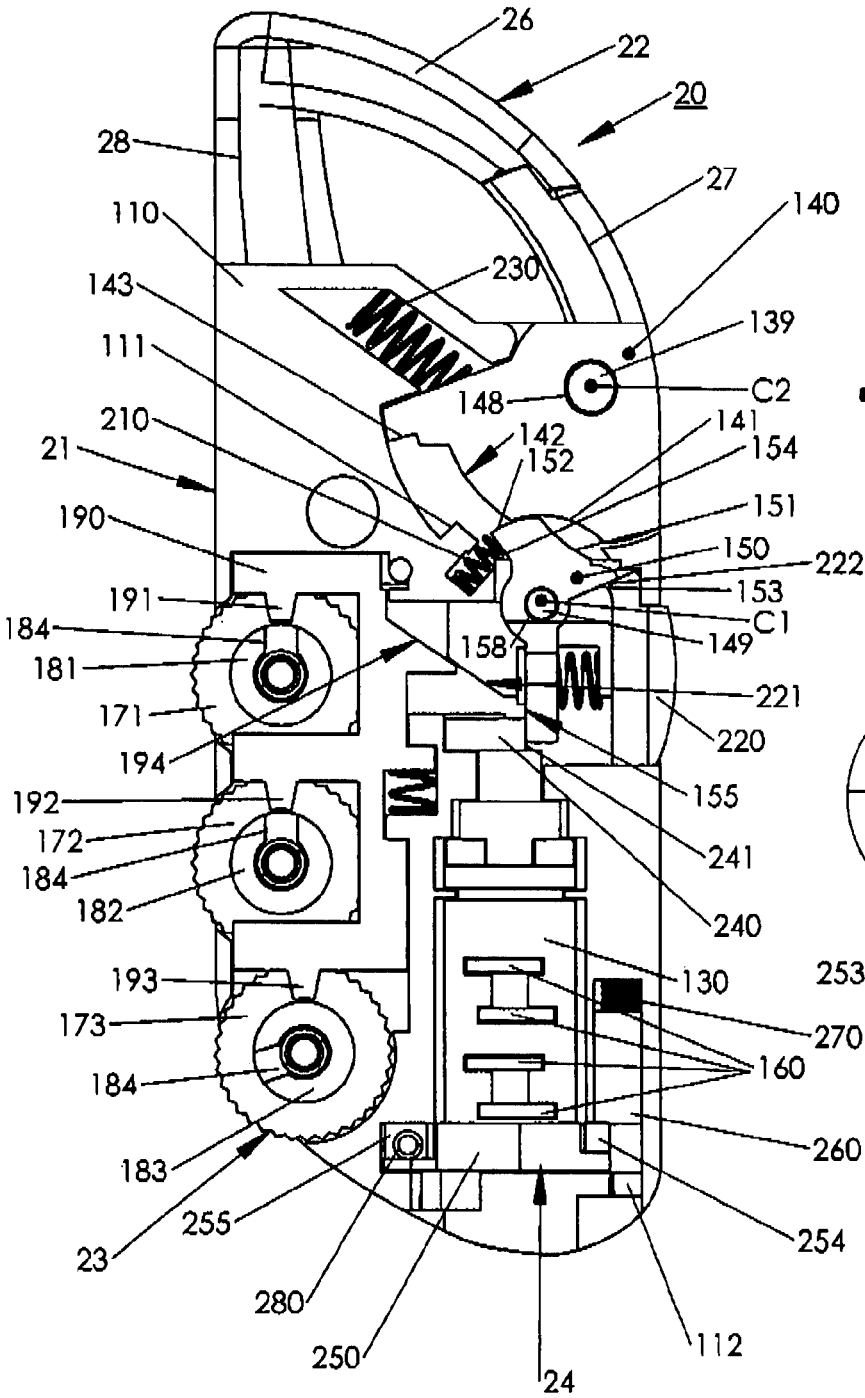
FIG. 1 is a side elevation view of one embodiment of the dual locking padlock of the present invention shown with the cover plate removed and in the locked mode.
Figure 2:
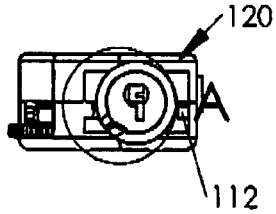
FIG. 2 is an end view of the dual locking padlock of FIG. 1.
Figure 3:
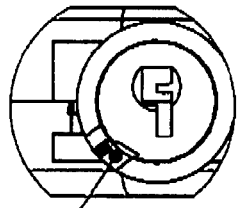
FIG. 3 is a greatly enlarged view of portion A of FIG. 2.
Figure 4A:
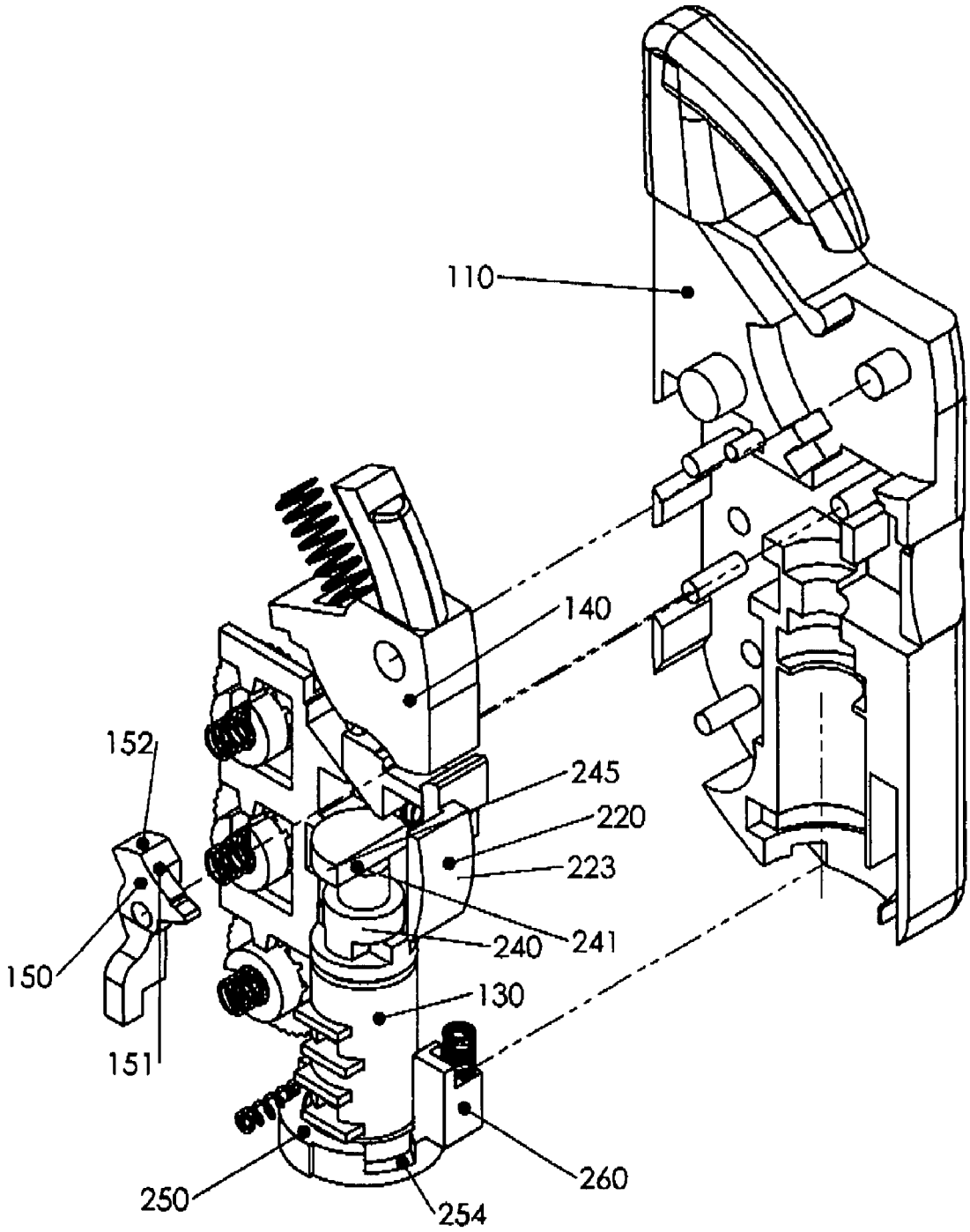
FIG. 4A is an exploded perspective view of the dual locking padlock of FIG. 1.
Figure 4B:
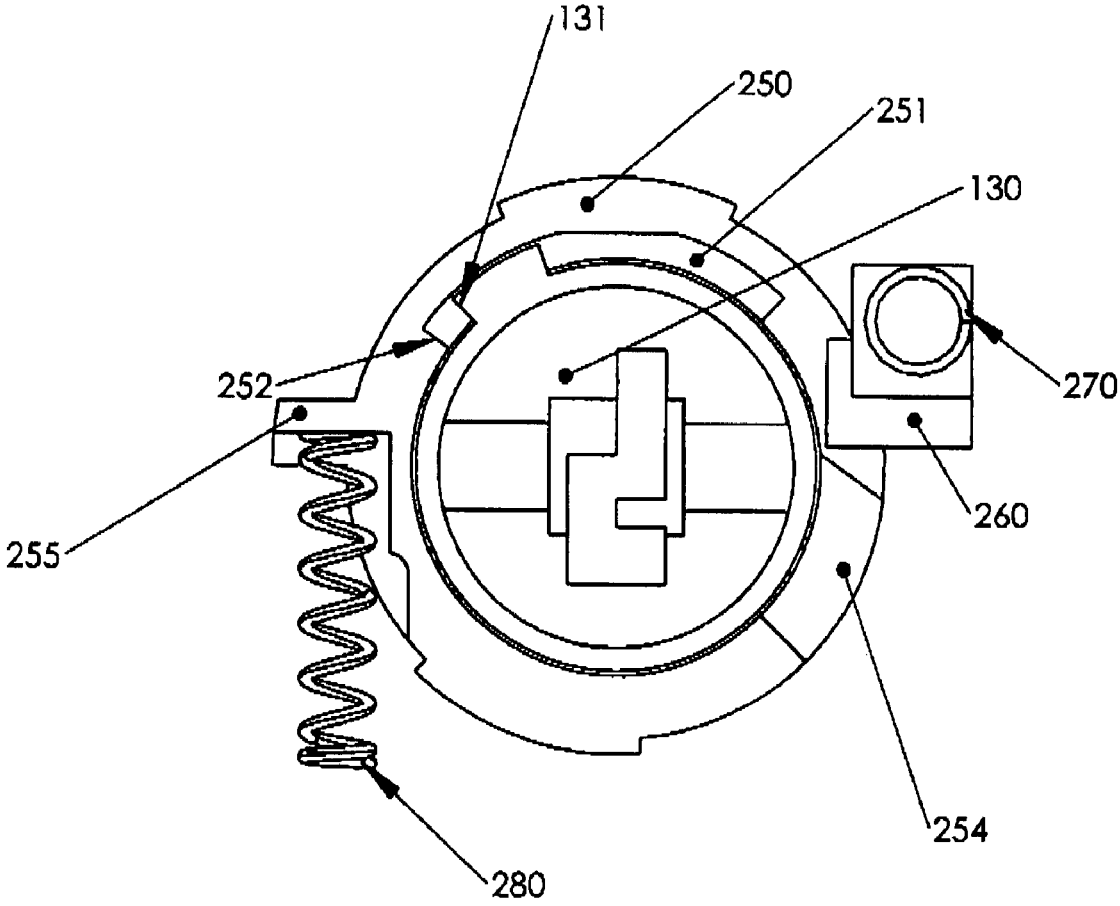
FIG. 4B is an enlarged end view of the combination controlled locking section of the dual locking padlock of the present invention with details of the alert system depicted.

In order to assure that trigger member 150 is normally maintained in its mounting block locking position, as depicted in FIG. 1, spring member 210 is mounted in housing 21 in biasing engagement with trigger member 150. As shown, spring member 210 is positioned for normally forcing trigger member 150 to be positioned with arcuately curved zone 152 cooperatingly associated with arcuately curved zone 141 of mounting block 140, effectively preventing mounting block 140 from pivoting.

Furthermore, whenever trigger member 150 is pivoted into its second position in response to the activation of either combination controlled section 23 or key control section 24, as detailed below, the locking engagement of mounting block 140 is released and mounting block 140 is capable of pivoting about support post 139. In order to assure that this arcuate pivoting movement is immediately attained whenever trigger member 150 is moved into its second position, biasing spring 230 is mounted in housing 21 in engagement with mounting block 140, for causing mounting block 142 to arcuately pivot whenever mounting block 140 is released.

In the preferred construction of this embodiment of the present invention, combination controlled section 23 of padlock 20 comprises a plurality of indicia bearing rotatable dials 171, 172, and 173 for setting and inputting a desired combination for locking and unlocking padlock 20. In order to enable the user to readily display any desired combination, housing 21 preferably comprises a plurality of apertures formed thereon for displaying the indicia formed on the rotatable dials. In this regard, the construction of combination controlled section 23 is similar to the construction detailed in U.S. Pat. No. 6,408,660, the pertinent portions of which are hereby incorporated by reference.

As shown, rotatable dials 171, 172, and 173 are each mounted in cooperating association with one clutch ring 181, 182, or 183. Furthermore, in order to maintain clutch rings 181, 182, and 183 in frictional engagement with dials 171, 172, and 173, a spring member is co-axially associated with each assembly to provide the required biasing force for maintaining each clutch ring in continuous frictional engagement with its associated dial. In this way, rotational movement of dials 171, 172, and 173 about their central axis causes clutch rings 181, 182, and 183 to rotationally move therewith.

Although the detailed construction and operation of dials 171, 172, and 173, and cooperating clutch rings 181, 182, and 183 are fully detailed below, as well as in U.S. Pat. No. 6,408,660 one structural feature which is important to note is the incorporation of slot 184 formed in each clutch ring 181, 182, and 183. As fully detailed herein, slot 184 of each clutch ring controls the locking and unlocking of padlock 20 in combination with the rotation of dials 171, 172, and 173.

In order to provide the desired locking and controlled release of shackle 22 of padlock 20 whenever combination controlled section 23 is employed, combination controlled section 23 also incorporates locking plate 190. In its preferred construction, locking plate 190 is mounted in longitudinal, sliding relationship with housing 21, and incorporates finger members 191, 192, and 193, each of which are aligned with one of the slots 184 formed in clutch rings 181, 182, or 183.

As is more fully detailed below, whenever rotatable dials 171, 172, and 173 are rotated into the pre-determined position established by the desired combination, slots 184 of each clutch ring 181, 182, and 183 are simultaneously positioned in alignment with finger members 191, 192, and 193. As a result, locking plate 190 is capable of longitudinal movement in housing 21, while finger members 191, 192, and 193 of locking plate 190 enter the associated slot 184. In addition, whenever an incorrect combination is entered on dials 171, 172, and 173, one or more of slots 184 of the associated clutch rings will be placed in a position which is not aligned with one of the associated fingers of locking plate 190. As a result, locking plate 190 will be incapable of longitudinal movement, resulting in padlock 20 being maintained in the locked position.

In order to enable locking plate 190 to move longitudinally in housing 21 when rotatable dials 171, 172, and 173 are properly arranged to display the desired preset combination, locking plate 190 incorporates sloping or ramped surface 194 integrally formed therewith and positioned for cooperating association with sloping surface 221 integrally formed as a part of button/pusher assembly 220. As depicted, button/pusher assembly 220 incorporates an enlarged, readily accessible surface 223 which any user is able to easily access for opening padlock 20 when the desired combination has been properly entered. In addition, button/pusher assembly 220 incorporates a slider portion incorporating sloping surface 221, which is mounted in cooperating, controlling engagement with sloping surface 194 of locking plate 190.

By employing this construction, whenever the pre-determined combination has been properly entered on the rotatable dials, the user is able to push surface 223, causing button/pusher assembly 220 to slidingly move within housing 21. This movement causes sloping surface 221 to contact sloping surface 194 of locking plate 190 and force locking plate 192 to move longitudinally in housing 21. Simultaneously, the protruding finger members of locking plate 192 are forced to enter the slots formed in each of the associated clutch rings. Whenever the predetermined combination is not properly entered on the rotatable dials, the longitudinal movement of locking plate 190 is prevented and button/pusher assembly 220 is incapable of movement.

Whenever the proper combination has been entered, the sliding movement of button/pusher assembly 220 also causes wall portion 222 of button/pusher assembly 220 to contact wall portion 153 of trigger member 150. In addition, as button/pusher assembly 220 is slidingly moved in housing 21 of padlock 20, the movement of wall portion 222 into engagement with wall portion 153 of trigger member 150 causes trigger member 150 to arcuately pivot about its pivot axis, effectively moving curved surface zone 152 out of blocking engagement with curved surface zone 141 of mounting block 140, enabling mounting block 142 to arcuately pivot about its associated pivot axis. In addition, once blocking engagement has been removed, spring 230 forces mounting block 140 to arcuately pivot, simultaneously causing section 27 of shackle 22 to be moved from the closed position to its open position. In this way, shackle 22 is released and padlock 20 is able to be opened.

In this preferred operation, mounting block 140 automatically stops its arcuate pivoting movement when wall portion 143 of mounting block 140 hits wall portion 111 of housing 21. While in this position, mounting block 140 remains in the open locked position with grooved surface zone 151 of trigger member 150 in contact with curved surface zone 142 of mounting block 140. Due to this construction, the shackle remains in a stable open position, as depicted in FIG. 5.

Whenever desired, mounting block 140 may be brought back to the locked position causing curved surface zone 142 of mounting block 140 to move away from groove surface zone 151 of trigger member 150. As soon as curved surface zone 142 of mounting block 140 moves into this position, trigger member 150 will return to its locked position, due to the spring forces imposed thereon by spring member 210 acting upon lever 154 of button/pusher assembly 220. Due to the spring force, trigger member 150 is forced to arcuately pivot into its original position, with curved surface zone 152 of trigger member 150 being brought into contact with groove surface zone 141 of mounting block 140.

In order to assure the smooth, easy, controlled operation of these components, spring means are cooperatively associated with locking plate 190 as well as button/pusher assembly 220 in order to bias these components into the desired positions, and requiring activation force to move these components into the unblocked position. In this way, the desired smooth operation of padlock 20 is realized.

In addition to opening padlock 20 by employing combination controlled section 23, padlock 20 may also be opened by employing key controlled section 24. By referring to FIGS. 1-14, along with the following detailed discussion, the construction and operation of padlock 20 for the locking and unlocking thereof by employing key controlled section 24 can best be understood. Furthermore, it should also be understood that alternate constructions of key controlled locking section 24 can be employed without departing from the scope of this invention. However, for exemplary purposes only, the preferred construction is fully detailed herein.

In this construction, key controlled locking section 24 of housing 21 of padlock 20 incorporates cylinder 130 which is mounted within a receiving cavity formed in housing 21 and constructed for enabling cylinder 130 to arcuately pivot whenever the correct key is inserted into a receiving slot formed in cylinder 130. In this regard, cylinder 130 incorporates a plurality of spring biased wafers which are constructed for being aligned in a precisely desired configuration whenever the matching key is inserted into the receiving slot thereof. Once inserted, the pivoting movement of cylinder 130 is attained.

As shown in the Figures, cylinder 130 incorporates cam head 240 mounted to the distal end thereof and constructed for arcuate pivoting movement simultaneously with the arcuate movement of cylinder 130 in response to the insertion and use of the correct key member. As a result, whenever the correct key has been inserted into the receiving slot formed in cylinder 130, and the key is employed to pivot cylinder 130, cam head 240 simultaneously pivots therewith.

As depicted, in the preferred construction, cam head 240 incorporates a radially extending flange portion 245 in combination with a flat surface or cutout zone 241. When padlock 20 is in the locked position, cutout zone 241 is positioned directly adjacent arm 155 of trigger member 150. As shown in FIG. 1, in this position, padlock 20 is secured and maintained in its locked configuration.

Upon insertion of the appropriate key into the cylinder 130, cylinder 130 is rotated by employing the key which simultaneously causes cam head 240 to rotate therewith. This rotation causes cutout zone 241 to contact arm 155 of trigger member 150, with radially extending flange 245 forcing arm 155 to move away therefrom, causing trigger member 150 to arcuately pivot into the unlocked position.

As detailed above, in the unlocked position, curved surface zone 152 of trigger member 150 is disengaged from groove surface zone 141 of mounting block 140 thereby enabling mounting block 140 to pivot, causing shackle 22 to open. Preferably, the key can be withdrawn from cylinder 130 once mounting block 140 is in the unlocked position.

Furthermore, when padlock 20 is to be returned to the locked position, the key is rotated back to the original position, causing radially extending flange 245 to arcuately pivot, bringing cutout zone 241 into aligned relationship with arm 155 of trigger member 150. Once in this position, the biasing spring associated with trigger member 150 causes trigger member 150 to arcuately pivot back to its original position, placing padlock 20 in the securely locked configuration.

In the preferred construction of this embodiment of the present invention, an indicator member 250 is incorporated in key controlled locking section 24 for alerting the consumer whenever a key has been used to open padlock 20. In the preferred construction of this embodiment, indicator member 250 preferably comprises a circular ring or collar construction cooperatively associated with cylinder 130. In addition, cylinder 130 has a finger 131 which is placed in opening 251 of indicator member 250. Whenever the key is employed to pivot cylinder 130, finger 131 contacts wall 252 of indicator member 250 which causes indicator member 252 to arcuately rotate therewith.

In addition, indicator member 250 incorporates a protrusion 253 with the letters "ERT" printed thereon. In this way, whenever indicator member 250 is rotated, the letters "ERT" are brought into alignment with the letters "AL" which are formed on housing 21 of padlock 20. In this way, the word "ALERT" is automatically created in response to the use of a key for opening padlock 20.

In the preferred construction, the slot or opening 251 of indicator member 250 is formed at a certain angle. This angle allows finger 131 of cylinder 132 to turn back into the locked position without altering the position of indicator member 250 once indicator member 250 has been arcuately pivoted into the alert position. Furthermore, indicator member 250 incorporates slot 254 which prevents indicator member 252 from returning to the non-activated or normal position. In this regard, the turning of indicator member 250 causes slot 254 of indicator member 250 to move so that slot 254 is aligned with resetting plate 260. Spring member 270 forces resetting plate 260 to engage with slot 254 of indicator member 250, thereby preventing indicator member 250 from returning to its normal position.

In accordance with the present invention, indicator member 250 can only be reset into its original position by employing a resetting device 290, which is in the possession of the owner. In this way, any security personnel employing a key to open padlock 20 of the present invention is incapable of returning indicator member 250 to its original position. Consequently, the consumer is able to immediately know that padlock 20 has been opened by the security personnel.

In order to reset indicator member 250, reset key aperture 112 on housing 21 is constructed to receive reset device 290 by being inserted therein. Once reset device 290 is inserted into reset key aperture 112 of housing 21, finger 291 of reset device 290 contacts resetting plate 260, forcing resetting plate 260 to move rearwardly. This causes resetting plate 260 to be disengaged from slot 254 of indicator member 250. Furthermore, spring 280 is connected with flange 255 of indicator member 250 and, once resetting plate 260 is disengaged from slot 254, spring 280 forces indicator member 250 to turn back to its normal position. In this way, the letters "ERT" of indicator 260 are not aligned with the letters "AL" of housing 21, and indicator member 250 is returned to its normal position.

By employing this construction, the user is able to reset indicator member 250 at any desired time, regardless of the condition of combination controlled section 23. As a result, the user can reset indicator member 250 when combination controlled section 23 is either in the open position or in the closed and locked position. As a result, the resetting of indicator member 250 is totally independent of the condition of the combination controlled section 23.

In FIGS. 15-23, the second preferred embodiment of dual mode padlock 20 of the present invention is depicted. By referring to these Figures, along with the following detailed discussion, the construction and operation of this second preferred embodiment can best be understood. Furthermore, as is evident from this disclosure, a minimum number of principal components are employed, thereby achieving a dual mode padlock while also substantially reducing the complexity found in most prior art padlocks. In this way, the invention provides a highly effective, commercially desirable construction which is capable of being produced at competitive costs, while also providing the unique attributes of the present invention and all of the locking and theft deterrent features typically incorporated in prior art padlocks.

Furthermore, in a manner similar to the first embodiment detailed above, this second preferred embodiment of the present invention incorporates uniquely constructed dual curved zones formed in association with the shackle of the padlock, in combination with cooperating dual curved zones formed on a pivotable trigger member which is mounted in controlling engagement with the shackle. As detailed herein, by employing this construction, a highly effective, easily produced, dual mode padlock is realized which is capable of providing all of the attributes desired in a highly effective, competitively priced padlock, as is also achieved with the first preferred embodiment.

In this embodiment of the present invention, two of the principal components employed to form dual mode padlock 20 comprise housing 21 and shackle 22. In addition, housing 21 incorporates combination controlled locking section 23 formed on one side thereof and key controlled locking section 24 formed on the opposed side thereof. The component required for forming and operating combination controlled locking section 23 as well as the components required for forming and operating key controlled locking section 24 are all detailed below. However, regardless of the section used by an individual to lock and unlock padlock 20 of the present invention, movement of shackle 22 between a locked and unlocked position is employed.

In this embodiment of the present invention, shackle 22 comprises a generally U-shaped member 60 which incorporates a free terminating end 46 and an opposed end which incorporates mounting block 55 integrally formed therewith and is pivotally mounted to housing 21. As shown, free end 46 of shackle 22 is movably mounted into and out of engagement with receiving cavity 47 formed in housing 21. In this way, shackle 22 is placed in either locked engagement with housing 21 or is disengaged from housing 21. Furthermore, mounting block 55 of shackle 22 is pivotally mounted to housing 21 by securing mounting block 55 to upstanding support post 63 which is affixed to housing 21.

In the preferred construction of this embodiment of the present invention, mounting block 55 incorporates dual curved zones 61 and 62 formed in a side surface thereof. Furthermore, as is more fully detailed below, arcuately curved zone 61 preferably comprises an inwardly extending, concavely curved zone or groove zone, while curved zone 62 comprises an outwardly extending, convexly curved zone. As shown, curved zones 61 and 62 are preferably formed directly adjacent each other extending along one common side surface of mounting block 55.

By employing this construction, mounting block 55 is movably secured to support post 63 for arcuate pivoting movement relative thereto. In addition, as is fully detailed below, the arcuate pivoting movement of mounting block 55 is controlled by pivotable trigger member 30. Furthermore, since U-shaped shackle forming member 60 is affixed to mounting block 55, the arcuate pivoting movement of mounting block 55 causes U-shaped member 60 to move into and out of alignment with cavity 40 of housing 21. In this way, the opening and closing of dual mode padlock 20 is achieved, alternately enabling a user to gain access to padlock 20 through shackle 22, as well as preventing access to shackle 22 and any item to which padlock 20 has been secured.

In accordance with the present invention, the controlled movement of mounting block 55, and the resulting locking and unlocking of padlock 20 is achieved by employing trigger member 30. As shown, trigger member 30 incorporates hole or passageway 36 formed therein which enables trigger member 30 to be pivotally mounted to housing 21 by securing trigger member 30 to upstanding support post 36 which is affixed to housing 21 of padlock 20.

In addition, trigger member 30 incorporates two arcuately curved zones 32 and 33, formed adjacent each other on one side surface of trigger member 30. In the preferred construction, arcuately curved zone 33 comprises an inwardly extending, concavely curved zone or groove zone, while curved zone 32 comprises an outwardly extending, convexly curved zone.

Furthermore, as clearly depicted in the Figures, dual curved zones 32 and 33 of trigger member 30 are mounted in aligned, cooperating, controlling relationship with dual curved zones 61 and 62 of mounting block 55. As is fully detailed below, by employing this construction, the desired arcuate pivoting movement of mounting block 55 and the resulting opening and closing of shackle 22 is achieved.

In the preferred embodiment, the radius of curvature employed for defining curved zone 32 is substantially equivalent to the radius of curvature employed for forming curved zone 61. In this regard, both curved zones 32 and 61 employ the pivot axis defined by post 34 as the center point of both arcuate curves. Furthermore, as clearly shown in FIGS. 15, 16 and 17, whenever arcuately curved zone 32 is mounted within arcuately curved zone 61, pivoting movement of mounting block 55 is prevented, thereby causing member 60 of shackle 22 to be maintained in its aligned, shackle closed position, resulting in padlock 20 being maintained in the secured and locked position.

In addition, the radius of curvature employed for defining curved zone 33 is substantially equivalent to the radius of curvature employed for forming curved zone 62. In this regard, both curved zones 33 and 62 employ the pivot axis defined by post 63 as the center point of both arcuate curves.

As clearly shown in FIGS. 18-21, when trigger member 30 is arcuately pivoted into its second, alternate position, curved zone 33 of trigger member 30 is moved into cooperating alignment with curved zone 62 of mounting block 55. Once trigger member 30 is moved into this second position, mounting block 55 is capable of arcuate pivoting movement relative to housing 21, with curved surface 62 slidingly moving in juxtaposed, spaced, aligned relationship with curved zone 33. In addition, as detailed above, once mounting block 55 arcuately pivots into its second position, terminating end 46 of shackle 22 is movable out of engagement with cavity 47, thereby opening shackle 22 and resulting in padlock 20 being removable from the items to which it had been mounted.

Due to the construction of curved zone 32 of trigger member 30 and curved zone 61 of mounting block 55, wherein both curved zones comprise cooperating or identical radii of curvatures, along with curved zone 33 of trigger member 30 and curved zone 62 of mounting block 55 also comprising cooperating or identical radii of curvatures, the controlled arcuate pivoting movement of trigger member 30 and mounting block 55 is attained with padlock 20 being controllably moved between a securely locked position and an unlocked position. In addition, based upon the position of trigger member 30 relative to mounting block 55, mounting block 55 is either maintained in a secure, locked position or is able to be arcuately pivoted into its unlocked position.

In order to assure that trigger member 30 is normally maintained in its mounting block blocking position, as depicted in FIG. 15, spring member 70 is mounted in housing 21 in biasing engagement with trigger member 30. As shown, spring member 70 is positioned for normally forcing trigger member 30 to be positioned with arcuately curved zone 32 cooperatingly associated with arcuately curved zone 61 of mounting block 55, effectively preventing mounting block 55 from pivoting.

Furthermore, whenever trigger member 30 is pivoted into its second position in response to the activation of either combination controlled section 23 or a key control section 24, as detailed below, the blocking engagement of mounting block 55 is released and mounting block 55 is capable of pivoting about support post 63.

In the preferred construction of this embodiment of the present invention, combination controlled section 23 of padlock 20 comprises a plurality of indicia bearing rotatable dials which are employed for setting and inputting a desired combination for locking and unlocking padlock 20. In order to enable the user to readily display any desired combination, housing 21 preferably comprises a pre-defined position formed thereon for aligning the indicia formed on the rotatable dials.

As best seen in FIGS. 15-19, each rotatable dial is mounted in cooperating association with one clutch ring, with both components being mounted to elongated shaft 75. Preferably, the construction employed for combination controlled section 23 of padlock 20 is substantially identical to the combination controlled construction disclosed in U.S. Pat. Nos. 6,675,614 and 6,883,355, the pertinent portions of which are incorporated herein by reference. By employing this construction, elongated shaft 75 is axially movable relative to housing 21 of padlock 20 whenever the predefined combination has been properly entered on the rotatable dials.

Once an individual has entered the pre-defined combination on the rotatable dials, pushbutton 76 of elongated shaft 75 is pressed, causing shaft 75 to axially move relative to housing 21. This axial movement causes upstanding flange 77 of shaft 75 to be brought into contact with arm 31 of trigger member 30. In addition, as shaft 75 continues to move axially, upstanding flange 77 causes trigger member 30 to arcuately pivot about support post 34, effectively moving curved surface zone 32 out of blocking engagement with curved surface zone 61 of mounting block 55, enabling mounting block 55 to arcuately pivot about its associated pivot axis. In this way, shackle 22 is released in padlock 20 is able to be open.

Whenever desired, mounting block 55 may be brought back to the locked position causing curved surface zone 62 of mounting block 55 to move away from groove surface zone 33 of trigger member 30. As soon as curved surface zone 62 of mounting block 55 moves into this position, trigger member 30 will return to its locked position, due to the spring forces imposed thereon by spring member 70. Due to this spring force, trigger member 30 is forced to arcuately pivot into its original position, with curved surface zone 32 of trigger member 30 being brought into contact with groove surface zone 61 of mounting block 55.

In addition to opening padlock 20 by employing combination controlled section 23, padlock 20 may also be opened by employing key controlled section 24. By referring to FIGS. 20 and 21, along with the following detailed discussion, the construction and operation of padlock 20 for the locking and unlocking thereof by employing key control section 24 can best be understood. Furthermore, it should also be understood that alternate constructions of key control locking section 24 can be employed without departing from the scope of this invention. However, for exemplary purposes only, the preferred construction is fully detailed herein.

In this construction, key control locking section 24 of housing 21 of padlock 20 incorporates cylinder housing 40 which is mounted within the receiving cavity formed in housing 21 and is constructed for enabling a cylinder mounted therein to arcuately pivot whenever the correct key is inserted into a receiving spot formed in the pivotable cylinder member. In this regard, the cylinder member typically incorporates a plurality of spring biased pins which are constructed for being aligned in a precisely desired configuration whenever the matching key is inserted into the receiving slot thereof. Once inserted, the pivoting movement of the cylinder member is achieved.

As shown in the Figures, the pivotable cylinder member incorporates flange 41 extending from the distal end thereof and constructed for arcuate pivoting movement simultaneously with the arcuate pivoting movement of the cylinder member in response to the insertion and use of the correct key member. As a result, whenever the correct key has been inserted into the receiving slot formed in the cylinder, and the key is employed to pivot the cylinder, flange 41 simultaneously pivots therewith.

As depicted in the preferred construction, flange 41 is in direct controlling engagement with arm 35 of trigger member 30. As a result, the arcuate pivoting movement of flange 41 contacts arm 35, causing trigger member 30 to arcuately pivot about support post 34, causing trigger member 30 to arcuately pivot into it unlocked position.

As detailed above, in the unlocked position, curved surface zone 32 of trigger member 30 is disengaged from groove surface zone 61 of mounting block 55, thereby enabling mounting block 55 to pivot, causing shackle 22 to open. Furthermore, when padlock 20 is to be returned to the locked position, the key is rotated back to its original position, causing flange 41 to arcuately pivot which allows spring member 70 to force trigger member 30 into its original locked position.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to the understood that the following claims are intended to cover all of the generic and specific features of the invention herein described, and all statements of the scope of the invention which, as a matter of language, might be said to fall therebetween.

Having described our invention, what we claim as new and desire to Secure by Letters Patent is:

1. A dual mode locking padlock constructed for providing two separate and independent locking means in a single, integrated construction, said padlock comprising:

A. a housing incorporating a key controlled locking assembly formed therein and a combination controlled locking assembly formed therein and positioned adjacent to the key controlled locking assembly, with each of said locking assemblies being operable independently of the each other;

B. a locking member in the form of a shackle constructed for being movable between a locked position and an unlocked position, said unlocked position being controlled by the activation of either the key controlled locking assembly or the combination controlled locking assembly, and comprising a base a) formed at one and of the shackle, b) pivotally mounted to the housing, and c) incorporating a first curved zone and a second curved zone formed along a side edge of the base and positioned adjacent to each other, said first curved zone comprising a concave shape and said second curved zone comprising a convex shape; and C. a trigger member a) pivotally mounted to the housing in cooperating relationship with the base of the locking member, b) incorporating a first curved zone and a second curved zone formed along a side edge of the trigger member and positioned adjacent to each other, said first curved zone comprising a concave shape and said second curved zone comprising any convex shape, c) said first curved zone and second curved zone of the trigger member being positioned in controlling, cooperating, aligned relationship with the first curved zone and second curved zone of the base of the locking member for controlling the articulate pivoting movement of said base, and d) comprising a movement control arm formed thereon and constructed for controllably moving the trigger member relative to the housing in response to the activation of the combination controlled locking assembly or the key controlled locking assembly for positioning the first curved zone and second curved zone thereof in a desired position relative to the first curved zone and second curved zone of the base of the locking member, whereby activation of either the key controlled locking section or the combination controlled locking section causes the trigger member to move between a shackle locking position and a shackle releasing position.

2. The dual mode locking padlock defined in claim 1, wherein the pivot axis of the base of the shackle and the pivot axis of the trigger member are aligned with each other in juxtaposed, spaced, parallel relationship.

3. The dual mode locking padlock defined in claim 2, wherein the second, convexly shaped, curved zone of the trigger member is positioned in fully engaged, cooperating relationship with the first, concavely shaped, curved zone of the base of the shackle for maintaining the shackle in its closed and locked position.

4. The dual mode locking padlock defined in claim 2, wherein the first, concavely shaped, curved zone of the trigger member is positioned in cooperating relationship with the first, concavely shaped curved zone of the base of the shackle for enabling the shackle to arcuately pivot from its closed and locked position into its open, unlocked position.

5. The dual mode locking padlock defined in claim 4, wherein the arcuate pivoting movement of the base of the shackle causes the second, convexly shaped curved zone of the base of the shackle to move into cooperating, sliding relationship with the second, convexly shaped curved zone of the trigger member.

6. The dual mode locking padlock defined in claim 1, wherein the key controlled locking assembly is further defined as comprising a) a cylinder assembly mounted in the housing and incorporating a key receiving slot cooperatively associated with a plurality of tumblers for preventing the rotational of said cylinder whenever the designated key member is not present and enabling the rotational movement of the cylinder in response to the presence of the designated key member, and b) an upstanding flange mounted to the terminating end of said cylinder and positioned in cooperating, movement controlling the relationship with the trigger member for causing the trigger member to arcuately pivot whenever this cylinder is rotated in response to the presence of the designated key member;

whereby the rotation of the cylinder of the key controlled locking assembly causes the trigger member to move from the shackle locked position to the shackle unlocked position.

7. The dual mode locking padlock defined in claim 6, wherein the rotational movement of the cylinder in response to the presence of the designated key member also causes a ring portion mounted to the cylinder adjacent the key receiving slot to arcuately pivot therewith from a first non-alert designating position to a second alert designating position wherein the use of the key controlled locking assembly automatically causes an alert notice to be provided.

8. The dual mode locking padlock defined in claim 1, wherein the combination controlled locking assembly is further defined as comprising a) a plurality of dials mounted to the housing with each of said dials having a plurality of separate indicia bearing zones formed thereon, b) each of said dials also incorporating a receiving slot formed therein, c) a slider cooperatively associated with the plurality of dials and incorporating a plurality of flanges formed thereon and positioned for sliding interengagement into the slots of each of the dials when said dials are in the desired position, and d) an activating arm mounted to the slider for movement therewith and positioned in cooperating, controlled, movement engaging relationship with the trigger member for causing the trigger member to arcuately pivot whenever the slider is capable of movement due to the position of the plurality of dials.

9. The dual mode locking padlock defined in claim 8, wherein each of the dials are mounted in substantially side to side relationship with each other for rotational movement about cooperating, parallel axes, and said slider incorporates a substantially flat plate.

10. The dual mode locking padlock defined in claim 8, wherein the slider comprises a substantially elongated rod member with the dials mounted for rotational movement about said rod member.

11. The dual mode locking padlock defined in claim 1, wherein the shackle is further defined as comprising an elongated, arcuately curved member formed by a first section fixedly mounted to the housing and a second section mounted to the base for arcuate movement in response to the movement of said base, wherein said shackle is in the open position when the first section and second section are separated from each other and is in the locked position when the first section and second section are in aligned, substantially continuous relationship with each other.

12. The dual mode locking padlock defined in claim 1, wherein the shackle is further defined as comprising a substantially arcuately curved, U-shaped member securely affixed at one end to the base and cooperatively associated with the housing at the opposed end for movement between the locked position in the unlocked position.

13. The dual mode locking padlock defined in claim 1, wherein the concave curved zone of the base of the shackle and the convex curved zone of the trigger member are further defined as comprising substantially equivalent radii of curvatures.

14. The dual mode locking padlock defined in claim 1, wherein the convex curve zone of the base of the shackle and the concave curve zone of the trigger member are further defined as comprising substantially equivalent radii of curvatures.

15. The dual mode locking padlock defined in claim 1, wherein said trigger member is further defined as being spring biased for normally maintaining the shackle in its locked position.

16. The dual mode locking padlock defined in claim 1, wherein said padlock further comprises an activation button cooperatively associated with the trigger member and combination controlled locking assembly for being movable in response to the combination controlled locking assembly being properly activated, thereby enabling the activation button to move the trigger member from the shackle locking position to its shackle release position.

17. The dual mode locking padlock defined in claim 1, wherein the padlock further comprises:

D. an indicator assembly constructed for providing a positive notice to the user whenever the key controlled locking assembly has been used.

18. The dual mode locking padlock defined in claim 17, wherein said key controlled locking assembly comprises a cylinder mounted to the housing and constructed for rotational movement in response to the receipt of a designated key and said indicator assembly is further defined as comprising a ring mounted to the cylinder for rotation therewith from a first non-notice providing position to a second notice providing position in response to the rotational movement of the cylinder.

19. The dual mode locking padlock defined in claim 18, wherein said ring incorporates indicia formed thereon, said indicia comprising at least one selected from the group consisting of letters, numerals, alpha-numeric designations, colors, graphics, and pictures, and said indicia providing the alert signal based upon the position of the indicia relative to the housing.

20. The dual mode locking padlock defined in claim 19, wherein the indicator assembly can be reset whether the combination is in the locked or unlocked position.

21. The dual mode locking padlock defined in claim 19, wherein the indicator assembly contains a reset member.

22. The dual mode locking padlock defined in claim 19, wherein the indicator assembly comprises a first section and a second section, said first section comprising the indicia formed on the movable ring and the second section comprising indicia formed on the housing of the padlock adjacent the ring, whereby movement of the ring causes the first section and second section to be aligned, thereby providing the desired notice.

23. The dual mode locking padlock defined in claim 22, wherein said first section comprises the letters "ERT" and the second section comprises the letters "AL", whereby the rotational movement of the ring due to the use of the cylinder automatically causes the word "ALERT" to be formed.

* * * * *